US009630155B2

(12) United States Patent
Hotta et al.

(10) Patent No.: US 9,630,155 B2
(45) Date of Patent: Apr. 25, 2017

(54) SYSTEM AND A METHOD FOR DISPERSING BY CIRCULATION

(75) Inventors: Masaya Hotta, Toyokawa (JP); Yutaka Hagata, Toyokawa (JP); Yuu Ishida, Toyokawa (JP); Katsuaki Odagi, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 1117 days.

(21) Appl. No.: 13/814,127

(22) PCT Filed: Dec. 3, 2010

(86) PCT No.: PCT/JP2010/071676

§ 371 (c)(1),
(2), (4) Date: Apr. 9, 2013

(87) PCT Pub. No.: WO2012/017569

PCT Pub. Date: Feb. 9, 2012

(65) Prior Publication Data

US 2013/0194888 A1 Aug. 1, 2013

(30) Foreign Application Priority Data

Aug. 5, 2010 (JP) ..... 2010-176779
Nov. 15, 2010 (JP) ..... 2010-255170

(51) Int. Cl.
*B01F 5/10* (2006.01)
*B01F 3/12* (2006.01)
*B01F 7/00* (2006.01)

(52) U.S. Cl.
CPC ..... *B01F 5/108* (2013.01); *B01F 3/1221* (2013.01); *B01F 3/1271* (2013.01); *B01F 5/104* (2013.01);

(Continued)

(58) Field of Classification Search
CPC ..... B01F 5/108

(Continued)

(56) References Cited

U.S. PATENT DOCUMENTS 1,265,809 A * 5/1918 Navarre ..... D21D 1/02 241/157
2,685,499 A * 8/1954 Hood ..... C01F 11/462 366/137

(Continued)

FOREIGN PATENT DOCUMENTS

EP 1712271 A2 10/2006
EP 2623192 A1 8/2013

(Continued)

OTHER PUBLICATIONS

Supplementary European Search Report for corresponding EP Application No. 10855658.0 dated Jan. 1, 2016 (9 pages).

(Continued)

*Primary Examiner* — David Sorkin
(74) *Attorney, Agent, or Firm* — Finnegan, Henderson, Farabow, Garrett & Dunner, LLP

(57) ABSTRACT

A system and a method for dispersing by circulating a mixture that simplifies the structure of the part for sealing a shaft of a dispersing device and lengthens the life of the device are provided. The system for dispersing by circulating a slurry or liquid mixture to disperse substances in the mixture comprises a rotating and continuously dispersing device that disperses the mixture, a tank that is connected to an outlet of the dispersing device, a circulating pump that circulates the mixture, and a piping that in series connects the dispersing device, the tank, and the circulating pump. In the dispersing device the outflow of the mixture is greater than the inflow so that an amount of the mixture in the dispersing device is maintained at a level where a part for (Continued)

sealing a shaft that is provided inside the dispersing device is not immersed.

22 Claims, 10 Drawing Sheets

(52) U.S. Cl.
CPC ..... *B01F 5/106* (2013.01); *B01F 7/00858* (2013.01); *B01F 7/00866* (2013.01)

(58) Field of Classification Search
USPC ..... 366/136, 137, 182.2
See application file for complete search history.

(56) References Cited

U.S. PATENT DOCUMENTS 3,871,272 A * 3/1975 Melandri ..... C12G 1/0216 366/137
4,955,723 A * 9/1990 Schneider ..... B01F 13/1013 366/136
5,439,288 A * 8/1995 Hoffman ..... B01F 3/1242 366/117
2006/0260807 A1* 11/2006 Allard ..... F04C 2/084 166/267
2007/0189112 A1 8/2007 Knape
2009/0000989 A1* 1/2009 Hassan ..... B01F 3/04099 208/209

FOREIGN PATENT DOCUMENTS

| | | |
|---|---|---|
| JP | 63-49239 | 3/1988 |
| JP | 04-078429 | 3/1992 |
| JP | 2002-143662 | 5/2002 |
| JP | 2004-232290 | 8/2004 |
| JP | 2004-267991 | 9/2004 |
| JP | 2008-238005 | 10/2008 |
| WO | WO 2009/060661 A1 | 5/2009 |

OTHER PUBLICATIONS

International Search Report issued by the Japanese Patent Office in International Application No. PCT/JP2010/071676, mailed Apr. 19, 2011 (4 pages).

* cited by examiner

SYSTEM AND A METHOD FOR DISPERSING BY CIRCULATION

TECHNICAL FIELD

The present invention relates to a system and method for dispersing by circulating a slurry or liquid mixture to disperse the substances in the mixture.

BACKGROUND ART

An exemplary system for circulating a slurry or liquid mixture to disperse substances in a mixture is disclosed in Japanese Patent Laid-open Publication No. 2004-267991. In a system for dispersing by circulation like this, the following must be considered in order to use a rotating and continuously dispersing device. That is, in such a device, an O ring, an oil seal, a gland packing, a mechanical seal, or the like is used for a part for sealing a shaft that prevents the leakage of the mixture through the axis. When preventing the leakage of a slurry that has a high concentration, such as a concentration of solids over 40 to 50%, often a mechanical seal is used.

However, there are problems in using a mechanical seal. The structure of it is complicated, the seal is large, and its cost is high. Moreover, if a mixture penetrates the seal and particulates enter there, the sealing surface (shaft seal side) is damaged, to deteriorate the performance. Therefore, there is also a problem in that a double mechanical seal, which is especially expensive and has a more complicated structure, will be needed.

DISCLOSURE OF INVENTION

The purpose of the present invention is to provide a system and a method for dispersing a mixture by circulation that enables the structure of the part for sealing a shaft of a dispersing device to be simple and its life to be longer while dispersing the mixture by circulating it.

The system for dispersing by circulating a mixture of the present invention that disperses a slurry or liquid mixture by circulating it comprises a rotating and continuously dispersing device that disperses the mixture, a tank that is connected to the outlet of the dispersing device, a circulating pump that circulates the mixture, and a piping that connects in series the circulating pump that circulates the mixture, the dispersing device, the tank, and the circulating pump. In the system the outflow of the mixture from the dispersing device is greater than the inflow into it, so that the amount of the mixture in the dispersing device is maintained at a level where the part for sealing a shaft that is provided inside the dispersing device is not immersed. Herein, the wording "the inflow of the mixture from the dispersing device is greater than the inflow into the device" means that the amount (or flow rate) of the mixture that flows out of the dispersing device is at least the same as, or greater than, the amount (or flow rate) of the mixture that flows into the dispersing device. The outflow from the dispersing device is not necessarily always greater than the inflow into it, but may be intermittently greater than the inflow.

The method for dispersing by circulating a mixture of the present invention that disperses a slurry or liquid mixture by circulating it comprises the steps of dispersing a mixture by a rotating and continuously dispersing device, dispersing the mixture by circulation through a piping that connects in series the dispersing device, a circulating pump that is connected to the outlet of the dispersing device, and the dispersing device, so that the amount of the mixture in the device is maintained at a level where the part for sealing a shaft that is provided inside the dispersing device is not immersed.

By the present invention, since no mixture penetrates the part for sealing a shaft, the structure of that part can be simplified, and the mixture can be properly dispersed by circulating it. Further, since the life of the part for sealing a shaft can be lengthened, the maintenance for the dispersing device and the entire system can be reduced. Therefore, the present invention achieves a simplified structure, simplified maintenance, and a low cost.

The basic Japanese patent applications, No. 2010-176779, filed Aug. 5, 2010, and No. 2010-255170, filed Nov. 15, 2010, are hereby incorporated by reference in their entireties in the present application.

The present invention will become more fully understood from the detailed description given below. However, the detailed description and the specific embodiments are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Below, a system 30 for dispersing by circulating a mixture of the present invention is discussed with reference to the drawings. Though the system 30 for dispersing by circulating a mixture that disperses a slurry mixture 31 by circulating it (also called "solid-liquid dispersion" or "slurrying") is below discussed, the present invention is not limited to this. It has an effect on dispersing a liquid mixture by circulating it (also called "liquid-liquid dispersion" or "emulsification"). Herein "dispersion" means dispersing substances in the mixture, i.e., mixing them so that each substance in the mixture is dispersed uniformly. Moreover, a device or method for "dispersing by circulating a mixture" includes one for dispersing by circulating a mixture and by adding additives.

Figure 1:
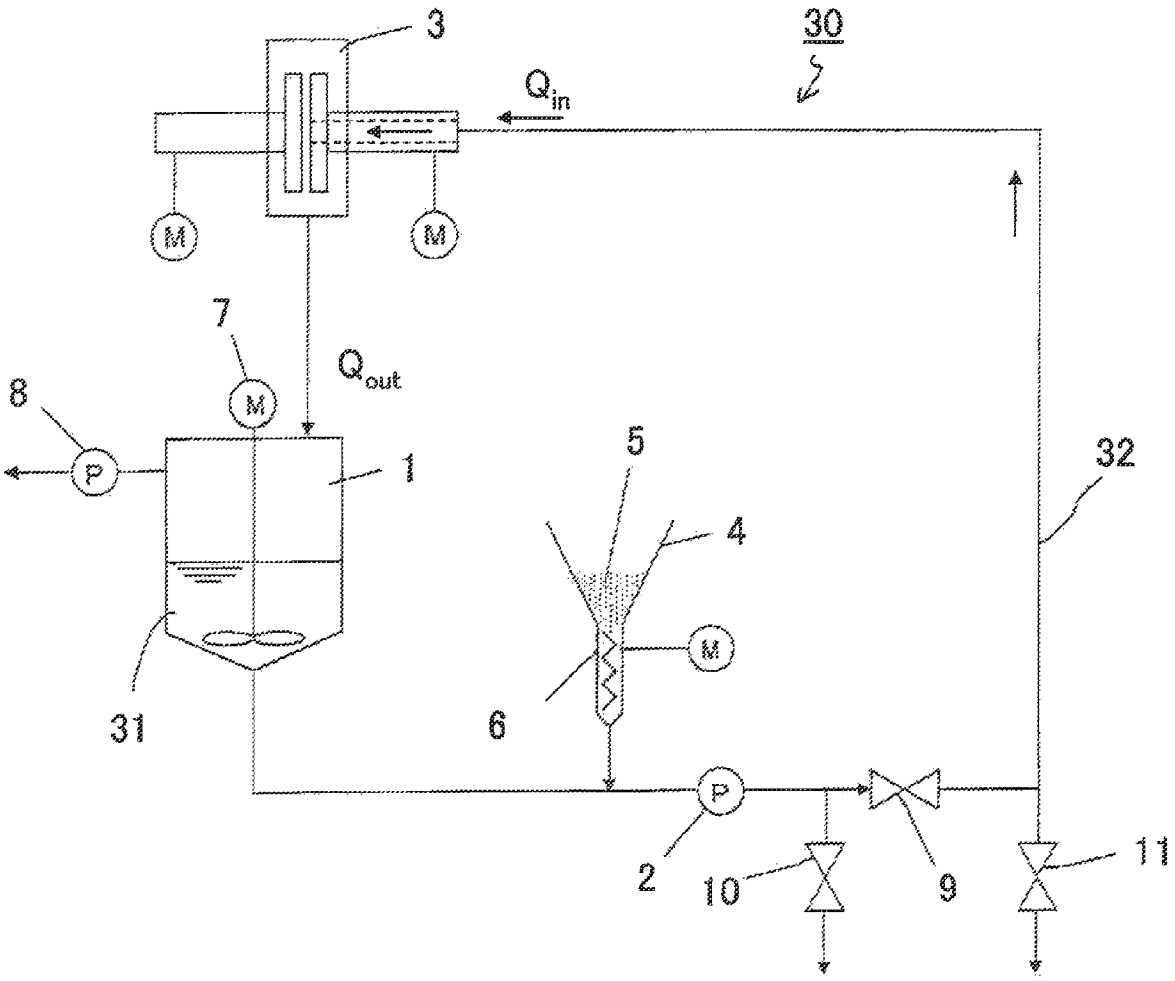
FIG. 1 is a schematic diagram that illustrates a system for dispersing by circulating a mixture of the present invention.

As shown in FIG. 1, the system 30 for dispersing by circulating a mixture comprises a rotating and continuously dispersing device 3 that disperses the mixture 31. It comprises a tank 1 that is connected to the outlet of the dispersing device 3 and a circulating pump 2 that is connected to the outlet of the tank 1 to circulate the mixture 31. It also comprises a piping 32 that connects in series the dispersing device 3, the tank 1, and the circulating pump 2. In the dispersing device 3, the outflow is greater than the inflow, so that the amount of the mixture 31 in the dispersing device 3 is maintained at a level where the part 16 for sealing a shaft (refer to FIG. 2) that is provided in the dispersing device 3 is not immersed.

At first the fluid that circulates through the tank 1, the dispersing device 3, and the piping 32 is a raw material. It gradually becomes a mixture in which additives are dispersed as it goes through the dispersing device 3. Finally it becomes a processed mixture that has been dispersed. In the above and following discussion both the first "raw material" and the "mixture" that is being processed are called a "mixture."

Figure 2:
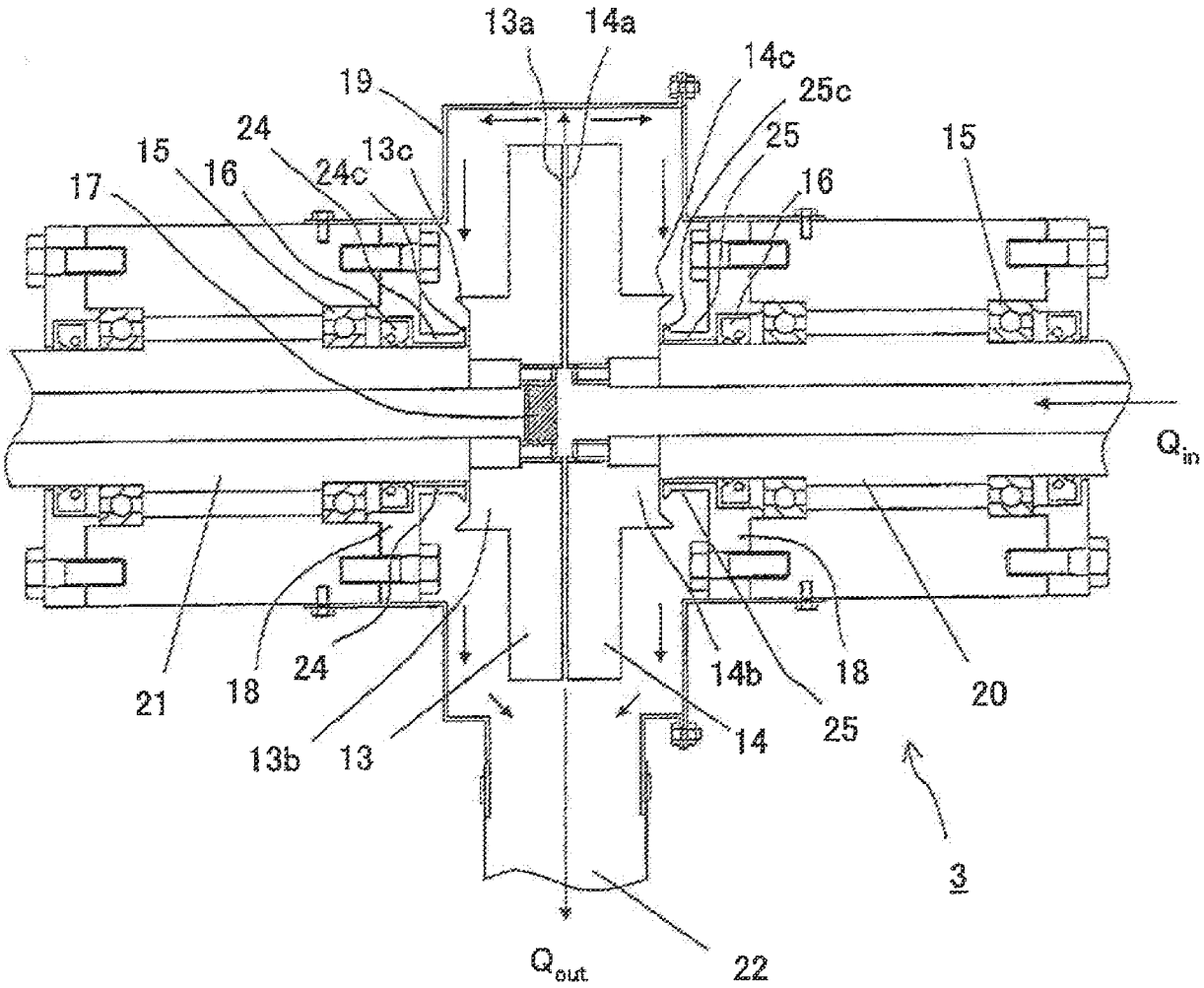
FIG. 2 is a schematic sectional drawing of the dispersing device of the system for dispersing by circulating a mixture of FIG. 1.

As shown in FIGS. 1 and 2, the system 30 for dispersing by circulating a mixture has a rotating and continuously dispersing device 3 in which the mixture is supplied from the hollow portion of a rotating hollow shaft. The mixture is supplied to the dispersing device 3 by the circulating pump 2. The rate of the discharged mixture (also called "the outflow") $Q_{out}$ that is discharged from a rotor cover 19, which is the casing of the dispersing device 3, is made to be greater than the rate of the supplied mixture (also called "the inflow") $Q_{in}$ that is supplied by the circulating pump 2. Thus no mixture accumulates within the rotor cover 19. Further, no mixture reaches the part 16 for sealing a shaft by using the centrifugal force of the rotors 13 and 14.

Below, the system is discussed in detail. As shown in FIGS. 1 and 2, the discharging port of the tank 1, which is a storage tank for the mixture, is connected to the circulating pump 2. The circulating pump 2 conveys and circulates the mixture. A feeder 6 that is provided on the piping for the circulation adds additives 5 (in the form of a fluid or powder) stored in a hopper 4 to the mixture (a raw material at first) that circulates. The mixture, after the additives are added, is supplied to the rotating and continuously dispersing device 3 that is installed above the tank 1 in the vertical direction.

The rotors 13 and 14 of the dispersing device 3 are constituted so that they rotate in reverse directions. The rotors 13 and 14 cause the additives to be uniformly dispersed in the raw material. The mixture that has been processed for being dispersed between the rotors 13 and 14 of the dispersing device 3 is returned to the tank 1 by gravity, without accumulating in the rotor cover 19 of the dispersing device 3. The mixture in the tank 1 is prevented from being segregated, by stirring it by an agitator 7.

As the feeder 6 for the raw material of the additives 5, a screw feeder, a rotary valve, a plunger pump, etc., can be suitably used. The feeder 6 may be placed at an arbitrary position in the piping 32. It may be placed on the tank 1, etc.

A vacuum pump 8 is connected to the tank 1. When the amount that is discharged from the dispersing device 3 is too low, the vacuum pump 8 can decompress the tank 1 to assist the discharge. Further, the decompression by the vacuum pump 8 may serve for degassing the mixture when air bubbles mix with the mixture.

In the system 30 for dispersing by circulating a mixture, the valve 9 is normally open and the valves 10 and 11 are normally closed, when the system is operating. When the dispersion is completed, the valve 9 is closed and the valve 10 is opened. Thereby, the processed mixture can be discharged through the valve 10 to then be recovered. Further, the mixture that remains in the dispersing device 3 or the piping 32 may be discharged by opening the valve 11 and recovered. The valve for discharging or recovering the mixture can be placed at an arbitrary place in the tank or the piping.

Next, with reference to FIG. 2, the flow of the mixture in the rotors portion of the dispersing device 3 is discussed. First, the mixture from the circulating pump 2 is supplied to a gap (a shearing part) between a pair of rotors 13 and 14 that rotate through the center of the hollow shaft that is rotated by the electric motor M, which is shown in FIG. 1. The mixture that has been supplied is radially discharged by the centrifugal force from the outer circumferences of the rotors through the gap between the pair of rotors 13 and 14. When doing so, a shearing force is applied to the mixture by the rotors 13 and 14, and thus the mixture is dispersed. The mixture that is discharged from the rotors 13 and 14 collides with the inner wall of the rotor cover 19 and flows down on it to be discharged from a discharging port 22 that is located in the lower portion.

The rotors 13 and 14 have shapes that prevent the mixture that flows from the rotor cover 19 from splashing the rotating shafts 20 and 21. That is, projections 13*c* and 14*c* for protecting the shaft are formed in the outer circumferences of the back faces 13*b* and 14*b* that are the reverse faces of the faces 13*a* and 14*a* that face each other. Further, members 24 and 25 for protecting the seal are provided in the circumference of the part 16 for sealing a shaft, such as an oil seal. The members 24 and 25 for protecting the seal have respective projections 24*c* and 25*c* for protecting the shaft. The members 24 and 25 for protecting the seal are integrally formed in members 18 for fastening the seal that fasten the respective parts 16 for sealing. However, they may be formed as other parts.

The projections 13*c*, 14*c* for protecting the shafts are upward projections that are shaped as rings in the outer circumferences of the back faces 13*b*, 14*b*. They cause the mixture to radially and outwardly fly from the inner wall of the rotor cover 19 by applying a centrifugal force to the mixture that flowed and fell through the members 24, 25 for protecting the seals. Thus the rotating shaft 20 is prevented from contacting a liquid (being splashed or being adhered to).

The projections 24*c*, 25*c* for protecting the shafts are upward projections that are shaped as rings in the outer circumferences of the ends of the members 24, 25 for protecting the seals. They prevent the mixture that is introduced from the inner wall of the rotor cover 19 from contacting the rotating shafts 20, 21.

The mixture that is prevented from flowing to the shafts 20, 21 by the projections 24*c*, 25*c* for protecting the shafts that are formed as upward projections that are shaped as rings flows down the members 24, 25 for protecting the seals. It flows out of the discharging port 22 of the dispersing device 3 to the tank 1. In FIG. 2, $Q_{in}$ denotes the flow of the mixture and $Q_{out}$ denotes the flow of the mixture that has been dispersed and is discharged to the tank 1.

The centrifugal force to move the mixture radially and outwardly is generated in the rotors 13, 14 by the rotation. The member 18 for fastening the seal has a shape so as to prevent the mixture from reaching the shafts, even if the mixture flows from the rotors 13, 14 or the rotor cover 19, as discussed above. Since the rate of the mixture (the rate of the outflow) that flows out of the discharging port 22 is constituted so that it is greater than the rate of the mixture that is supplied from the circulating pump 2, the mixture does not accumulate in the rotor cover 19. For having the rate of the mixture that flows out (outflow) be greater, the diameter of the piping may be enlarged, for example. The dispersing device 3 is equipped with a bearing 15 and a plug 17 for preventing the mixture from flowing back.

The viscosity of the mixture or the raw material may be so high that it becomes difficult to have a sufficient amount flow through the discharging port of the rotor cover 19 only by means of gravity, due to the fluid resistance. If the amount of the mixture supplied from the circulating pump 2 is regularly greater than the amount of it discharged out of the rotor cover 19, the air in the tank 1 in FIG. 1 may be evacuated by the vacuum pump 8 so that the tank 1 is in a vacuum. Thus the discharge from the rotor cover is accelerated. The vacuum pump 8 also functions to reduce the air bubbles mixed in the liquid. It may make the tank a vacuum for that purpose. In this case, it is necessary to install a seal that maintains a vacuum at the seal portions of the rotating shafts. Thus, the vacuum pump 8 functions as a decompressing pump that decompresses the tank 1.

Figure 3:
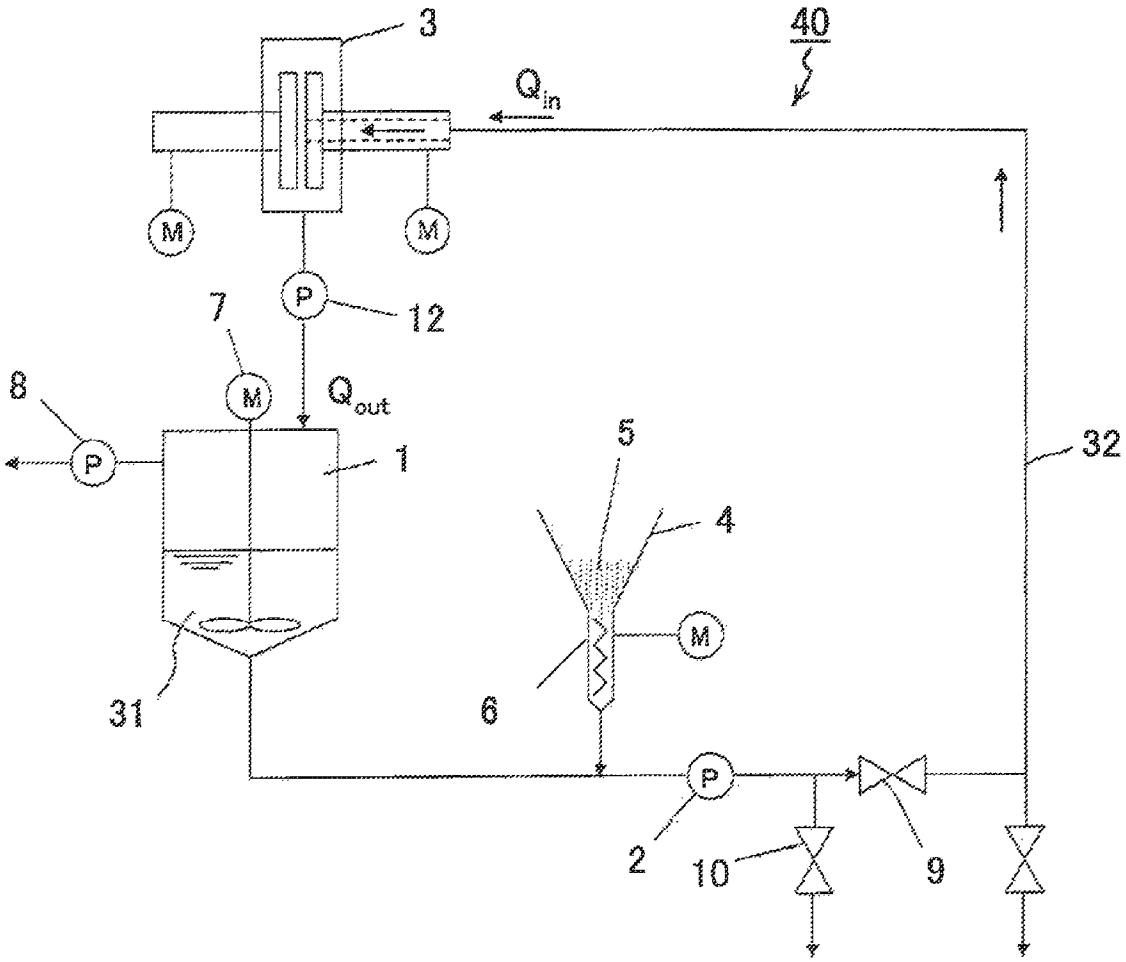
FIG. 3 is a schematic diagram illustrating another embodiment of the system for dispersing by circulating a mixture of the present invention.

Further, if the amount of the mixture $Q_{out}$ that flows out of the rotor cover 19 is not great enough even though the tank 1 is decompressed, a pump 12 may be connected between the discharging port 22 of the rotor cover 19 and the raw-material returning port of the tank 1, as shown in FIG. 3, to force the mixture to be discharged. That is, FIG. 3 illustrates the modification of the system 30 for dispersing by circulating a mixture as in FIG. 1. That system is denoted as the system 40 for dispersing by circulating a mixture. Since the structure of the system 40 is the same as that of the system 30 except for the pump 12, the same symbols are used, and duplicate explanations are omitted. The pump 12 is placed in the piping between the outlet of the dispersing device 3 and the inlet of the tank 1. The pump 12 increases the outflow of the mixture from the dispersing device 3. Since the amount of the mixture $Q_{out}$ that flows out of the rotor cover 19 is determined by the capability of the pump 12, regardless of the effect of gravity in this case, the dispersing device 3 need not be installed above the tank 1.

Figure 4:
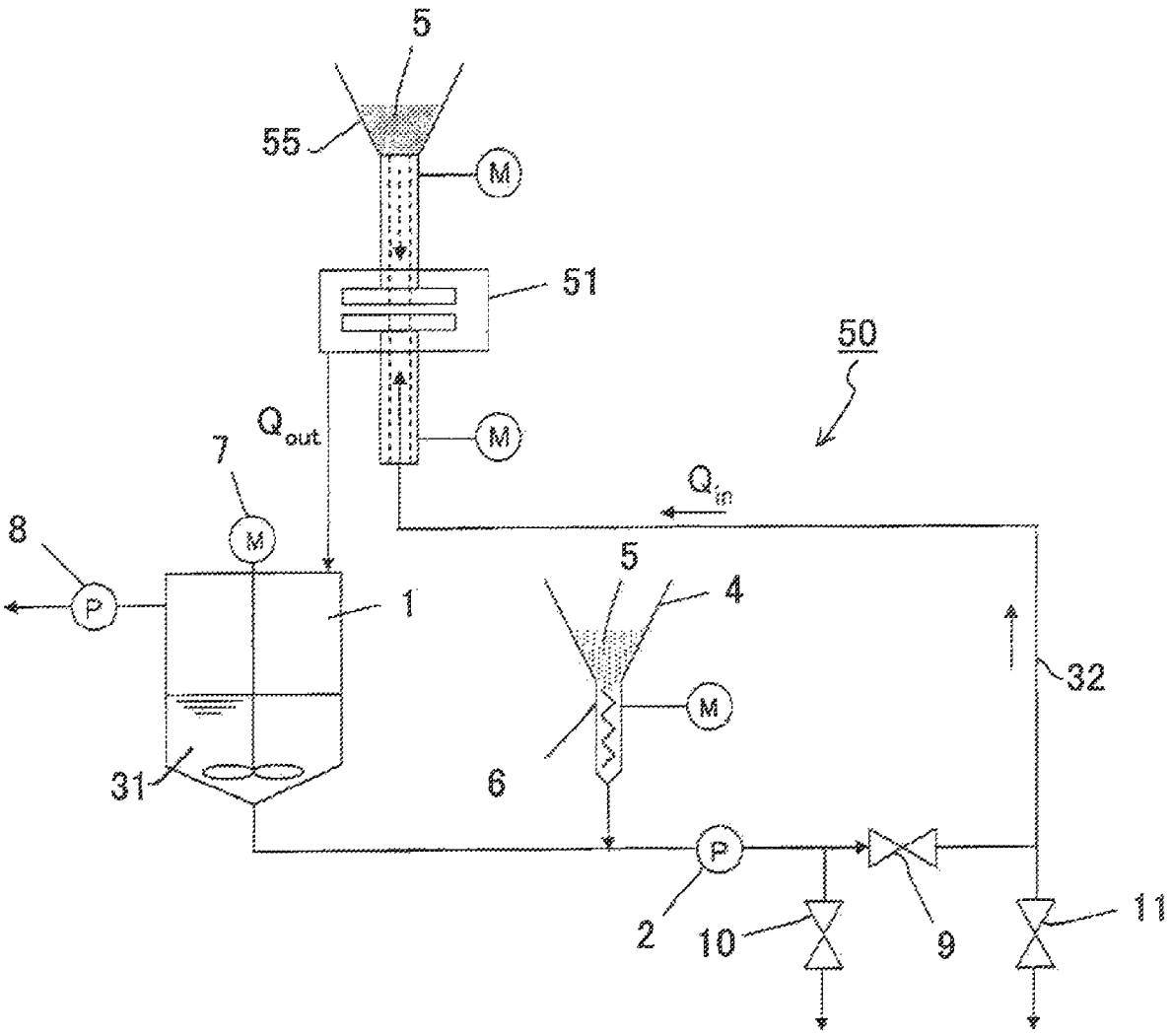
FIG. 4 is a schematic diagram illustrating yet another embodiment of the system for dispersing by circulating a mixture of the present invention.
Figure 5:
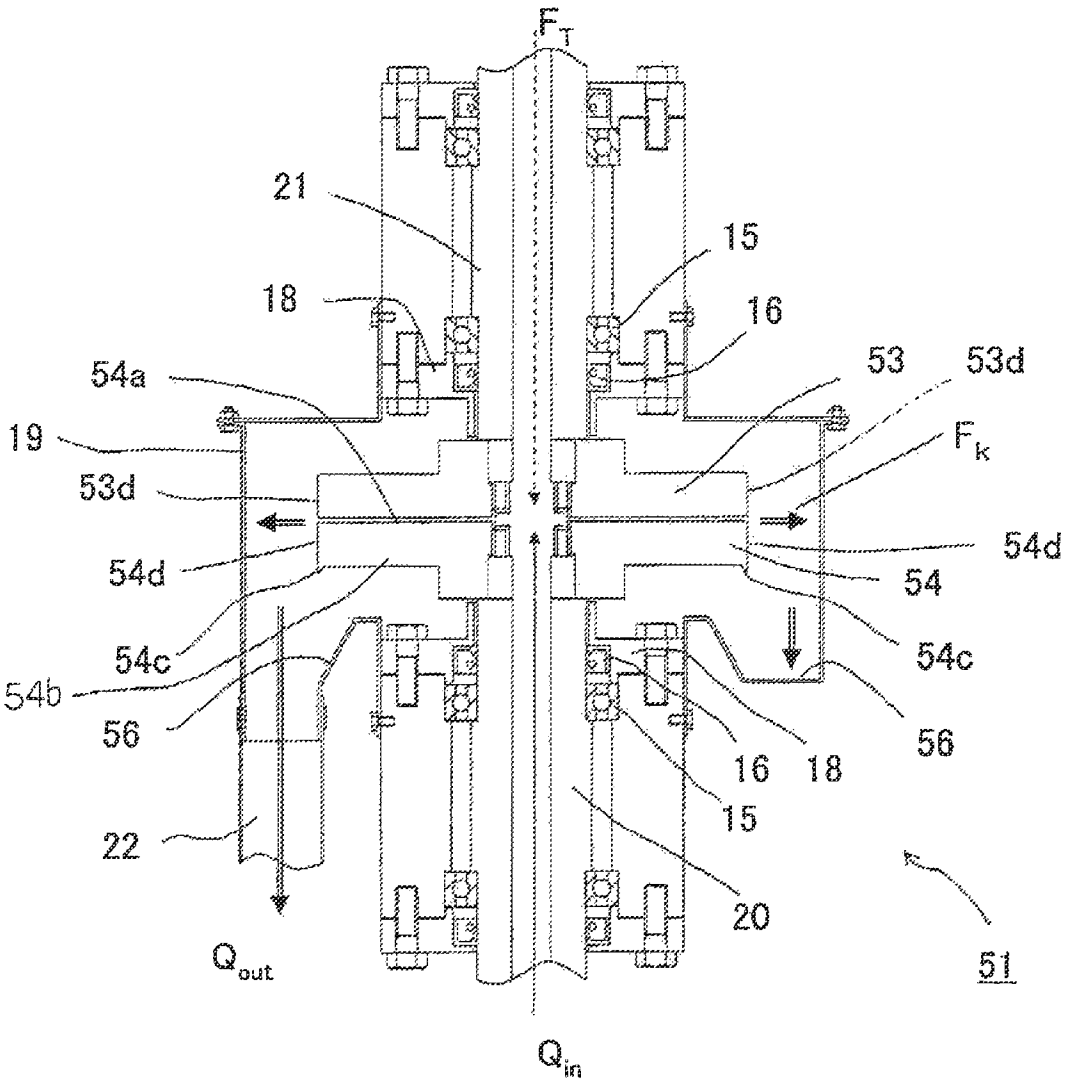
FIG. 5 is a schematic sectional drawing of the dispersing device that constitutes the system for dispersing by circulating a mixture of FIG. 4.

The dispersing device 3 need not have its shafts horizontal. As shown in FIG. 4, it may be a dispersing device that is positioned vertical. That is, FIG. 4 illustrates the modification of the system 30 for dispersing by circulating a mixture shown in FIG. 1. That system is denoted as the system 50 for dispersing by circulating a mixture. The dispersing device 3 that is discussed above may be used for the system 50 for dispersing by circulating a mixture as in FIG. 4. However, the rotating and continuously dispersing device 51 that is shown in FIG. 5 may be suitable. Since the structures of the system 50 and the dispersing device 51 are the same as those of the system 30 and the dispersing device 3, respectively, except for the matters that are discussed below, the same symbols are used for the same members, and duplicate explanations are omitted. In the system 50, by adding the pump 12 that is discussed with reference to FIG. 3, the same effect can also be achieved.

That is, the system 30 for dispersing by circulating a mixture of FIG. 1 and the system 50 for dispersing by circulating a mixture of FIG. 4 have in common the fact that the dispersing devices 3, 51 have respective pairs of rotors 13, 14 and 53, 54 and the pairs of rotors 13, 14 and 53, 54 disperse the mixture by discharging it from the gaps between the rotors 13, 14 and 53, 54 radially and outwardly. The difference between the system 30 of FIG. 1 and the system 50 of FIG. 4 is that the dispersing device 3 of FIG. 1 has its pair of rotors 13, 14 horizontal whereas the dispersing device 51 of FIG. 4 has its pair of rotors 53, 54 vertical. An advantage of the system 30 of FIG. 1 may be that the size of the system in the vertical direction can be made smaller. Below the structure and advantages of the system 50 of FIG. 4 are discussed in detail.

In the system 50 for dispersing by circulating a mixture as in FIG. 4, the mixture may be supplied from any part of the hollow portion of the hollow shaft of the upper rotor 53 and the lower rotor 54. However, for example, if it will be supplied from the hollow portion of the hollow shaft of the lower rotor 54 by a pump, then the additives 5 can be supplied from the shaft of the upper rotor. In this case, a hopper 55 that stores the additives 5 may be provided above the dispersing device 51.

As shown in FIG. 5, the rotors 53, 54 of the dispersing device 51 are constituted like the dispersing device 3 so that they rotate in reverse directions. The rotors 53, 54 cause the additives to be uniformly dispersed in the raw material. The raw material that has been dispersed between the rotors 53, 54 of the dispersing device 51 is returned to the tank 1 by gravity without it accumulating in the rotor cover 19 of the dispersing device 51.

Next, with reference to FIG. 5, the flow of the raw material and the additives in the dispersing device 51, which is an example of a vertical device, is discussed. First, the raw material that has been supplied to the device is supplied to the gap (the shearing part) between the pair of rotating rotors 53, 54 through the center of the hollow shaft that is rotated by the electric motor, which is not illustrated. The supplied raw material is radially discharged by the centrifugal force from the outer circumferences of the rotors 53, 54 after passing through the gap between the pair of rotors 53, 54. By doing so, the raw material is subject to a shearing force from the rotors 53, 54, and is dispersed. The raw material discharged from the rotors 53, 54 collides with the inner wall of the rotor cover 19. Then it flows down the wall and is discharged from the discharging port 22 that is located in the lower portion.

Since the additives 5 in the hopper 55 are drawn into the piping by the negative pressure that is generated by the rotation of the rotors 53, 54 or the by the evacuation of the air in the tank by a vacuum pump, the feeder 6 for additives in FIG. 4 will become unnecessary if the additives are supplied at a sufficient rate by that operation.

The rotors 53, 54 are configured to prevent the mixture that flowed from the rotor cover 19 from splashing the rotating shafts 20, 21. That is, the projection 54*c* for protecting the shaft is formed in the outer circumference of the back face of the lower rotor 54 of the pair of rotors 53, 54. More specifically, the projection 54*c* for protecting the shaft is formed in the outer circumference of the back face 54*b* of the lower rotor 54, which back face is the reverse face of the face 54*a* that faces the upper rotor 53.

The projection 54*c* for protecting the shaft is an upward projection that is shaped as a ring along the outer circumference of the back face 54*b*. It can prevent the mixture from contacting (splashing or adhering) the rotating shafts 20, 21 by causing the mixture that has flowed from the rotor cover 19, etc., to the outer circumferences 53*d*, 54*d* of the rotors 53, 54, to flow into a circumferential groove 56 (by leading the mixture downward). The mixture that has been prevented by the projection 54*c* from flowing to the shaft 20 is led to the discharging port 22 through the circumferential groove 56 of the rotor cover 19. It flows out of the discharging port 22 to the tank 1. In FIG. 5, $Q_{in}$ denotes the flow of the mixture and $Q_{out}$ denotes the flow toward the tank 1 of the mixture that has been dispersed. $F_T$ denotes the flow of the additives and $F_K$ denotes the flow of the mixture of the raw material and the additives.

The dispersing device 3 and the dispersing device 51, which are discussed with reference to FIG. 2 and FIG. 5, respectively, are configured to have respective pairs of rotors 13, 14 and 53, 54 that rotate in reverse directions. However, the dispersing device that constitutes the system 30, 40, 50 for dispersing by circulating a mixture, is not limited to that device. That is, the dispersing device in which either of a pair of rotors is changed to a stator that does not rotate may be used. Specifically, that dispersing device has a rotor and a stator that face each other. The mixture flows to the gap between the rotor and the stator through the hollow shaft. It is dispersed when it is radially and outwardly discharged from the gap.

In the dispersing devices 3 and 51 in FIG. 2 and FIG. 5, respectively, the pair of rotors may be configured to have the faces that face each other be formed of ceramics. By using ceramics for the faces, the resistance to wear improves so that durability improves when applying a high shearing force to the mixture. Now, a pair of rotors 61 and 62 that are applicable to the dispersing devices 3, 51 are discussed with reference to FIG. 6. Namely, the rotors 61, 62 that use the ceramics as discussed below can be used instead of the rotors 13, 14, 53, 54. The system 30, 40, 50 for dispersing by circulating a mixture that is equipped with the dispersing devices 3, 51 to which those rotors are applied can simplify the maintenance. Thus the cost may be reduced by that simplification.

Figure 6:
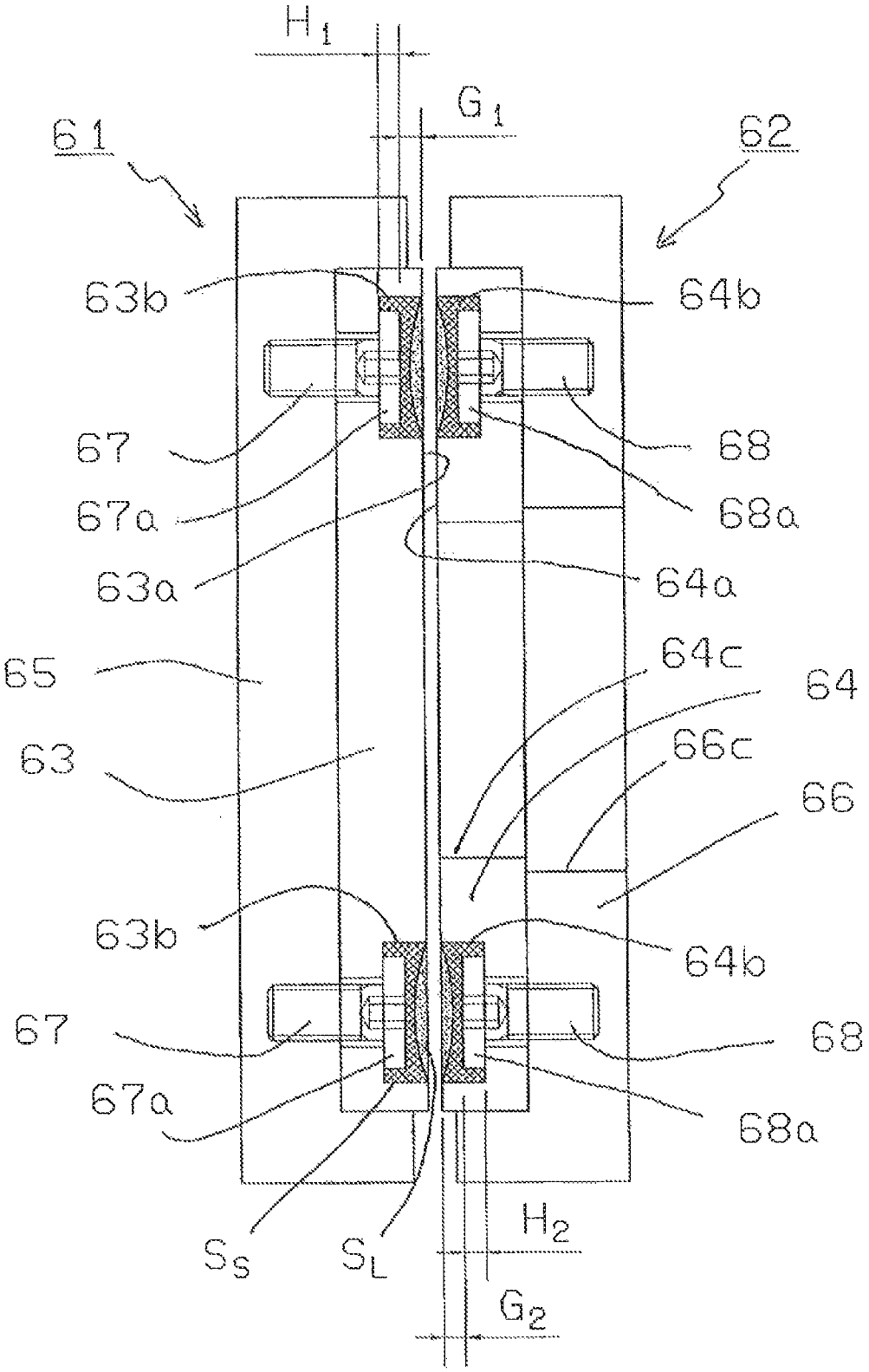
FIG. 6 is a sectional drawing of the rotors that illustrates another embodiment of the dispersing device that constitutes the system for dispersing by circulating a mixture, wherein ceramic members are used for the facing surfaces of a pair of the rotors.

As shown in FIG. 6, a pair of rotors 61, 62 comprise end members 63, 64 that have respective faces facing each other, mounting members 65, 66 that exchangeably have mounted the end members 63, 64 on them, and the fixing screws (such as bolts) 67, 68 that fix the end members 63, 64 to the mounting members 65, 66. The end members 63, 64 are made of ceramics. The mounting members 65, 66 are made of metal, etc. Though the end members 63, 64 and the mounting members 65, 66 may be fixed by adhesion, etc., fixing them by the fixing screws 67, 68 achieves the following advantages. The pair of rotors 61, 62 in which the end members 63, 64, which are ceramic members, can be mounted and demounted by the fixing screws 67, 68, facilitate the exchange of them compared with using adhesion. Thus the maintenance can be simplified. Thus the cost may be reduced by that simplification.

Further, the pair of rotors 61, 62 shown in FIG. 6 have the following features. That is, the fixing screws 67, 68 are screwed to the mounting members 65, 66 from the faces 63*a*, 64*a* of the end members 63, 64, which faces 63*a*, 64*a* face each other, to fix the end members 63, 64 to the mounting members 65, 66. The recesses 63*b*, 64*b* are formed in the portions where the fixing screws 67, 68 are screwed in the end members 63, 64. The recesses 63*b*, 64*b* are formed so that the heads 67*a*, 68*a* of the fixing screws 67, 68 may be located at positions which are at the lower end of the predetermined gaps G1, G2 from the faces 63*a*, 64*a* of the end members 63, 64, which faces 63*a*, 64*a* face each other, when the fixing screws 67, 68 are screwed to fix the end members 63, 64. The predetermined gaps G1, G2 are determined so that the heights H1 and H2 of the respective heads of the fixing screws 67, 68 comply with the equations $0.5\times H1<G1<1.5\times H1$ and $0.5\times H2<G2<1.5\times H2$, respectively.

Thus, the pair of rotors 61, 62 have the feature wherein the depths of the heads 67*a*, 68*a* of the fixing screws 67, 68 (i.e., the depths at the tips of the heads 67*a*, 68*a* from the faces 63*a*, 64*a* of the end members 63, 64) are greater than those that are usually assumed. Because of this feature the solid parts in the mixture fill in (are deposited in) the crevice (space) between the heads 67*a*, 68*a* of the fixing screws 67, 68 and the recesses 63*b*, 64*b* of the end members 63, 64. The filled (deposited) solid parts contact the slurry mixture, etc., that flows outside of the recesses 63*b*, 64*b*, i.e., the positions where the fixing screws 67, 68 are screwed. However, since it does not flow in the recesses 63*b*, 64*b*, it protects the heads 67*a*, 68*a*. In FIG. 6 $S_S$ denotes the deposited solid parts and $S_L$ denotes the mixture that can flow.

In other words, the pair of rotors 61, 62, which have that feature, can prevent wear of the heads 67*a*, 68*a* of the fixing screws 67, 68 by the solid parts since the heads 67*a*, 68*a* are located at the predetermined depth G1, G2, and the solid parts are deposited on them.

By using the pair of rotors 61, 62, the slots or holes for screwing the fixing screws 67, 68, such as plus slots, minus slots, hexagon sockets, etc., are prevented from being crushed. Thus trouble can be prevented. Further, any mixing with the mixture of metal dust (contamination) generated by the wear of the heads 67*a*, 68*a* can be prevented.

In the pair of rotors 61, 62, if $0.5\times H1>G1$ or $0.5\times H2>G2$, then the effects achieved by the deposited solid parts would be small. If $G1>1.5\times H1$ or $G2>1.5\times H2$, then the recesses 63*b*, 64*b* of the end members 63, 64 would become too large, such that the strengths would be low, or the amount of the deposited solid parts would be too large such that its removal would become troublesome. As a result, the range discussed before is proper.

By using the rotors 61, 62 instead of the rotors 13, 14, 53, 54, which rotors 61, 62 are made of ceramics and have the same characteristic structure as that of the dispersing device 3, 51, replacing the ceramic parts can be simplified and foreign substances can be prevented from mixing. Also, the dispersing device using the rotors 61, 62 has the effects (increasing durability, facilitating maintenance, and reducing costs) achieved by using ceramics. By constituting the system 30, 40, 50 for dispersing by circulating a mixture with the rotors 61, 62, the effects by the rotors 61, 62 can be achieved as well as the effects that were discussed before and will be discussed below. FIG. 6 illustrates an example where the hollow shaft for introducing the mixture is attached to the rotor 62 (the through-holes 64*c*, 66*c* are formed in the end member 64 and the mounting member 66 of the rotor 62). However, the hollow shaft may be attached to the rotor 6. Further, the hollow shafts may be attached to both rotors.

In FIGS. 1, 3, and 4, and FIG. 7, which is below referred to, M denotes an electric motor and P denotes a pump. The pump P for the systems 30, 40, and 50 is preferably a pump without a part for sealing a shaft, as, for example, a tube pump or a hose pump. If the pump has a part for sealing a shaft that contacts liquid, that part may deteriorate.

As seen from the above discussion, the system 30, 40, 50 for dispersing by circulating a mixture, to which the present invention is applied, has the features wherein it has the dispersing devices 3, 51, the tank 1, the circulating pump 2, and the piping 32, and the outflow of the mixture is greater than the inflow so that the mixture in the dispersing device is maintained at a level where no part for sealing a shaft 16 is immersed. The method for dispersing by circulating a mixture, to which the present invention is applied, has the features for a method for dispersing by circulating a slurry or liquid mixture wherein the mixture 31 is dispersed by the rotating and continuously dispersing device 3. When it is circulated through the piping 32 that connects in series the device 3, the tank 1 that is connected to the outlet of the device 3, and the circulating pump 2, then the outflow of the mixture is greater than the inflow, so that the mixture in the device is maintained at a level where no part for sealing a shaft 16 is immersed.

The system 30, 40, 50 for dispersing by circulating a mixture can simplify the structure of the part for sealing a shaft of the dispersing device to disperse the mixture, since no mixture reaches that part. Since the life of the part for sealing a shaft can be prolonged, the maintenance of the dispersing device or the entire system can be reduced. Thus, the system and the method achieve the simplification of the structure, simplification of the maintenance, and reduction of the cost.

The system 30, 40, 50 for dispersing by circulating a mixture causes the mixture to not reach the shaft seals of the rotating and continuously dispersing machine. Further, for using the rotating and continuously dispersing device to which the mixture is supplied from the hollow portion of the rotating hollow shafts, the system prevents the mixture from reaching the part for sealing the shaft, by using the rotations (centrifugal forces) of the shafts or the rotors and by controlling the inflow of the mixture into the rotors and outflow from the rotors. Thus no mixture reaches the part for sealing the shaft that seals the inside and the exterior of the casing (the rotor cover 19) that stores the rotor. By using the system, since no liquid reaches the part for sealing the shaft, the shaft seal can be simplified and its cost is reduced. Or the life of the shaft seal can be prolonged.

The system may also have a feature wherein the pump 12 shown in FIG. 3 is used to transfer liquid to discharge the mixture from the rotor cover 19. It may also have a feature wherein the amount of the mixture to be discharged from the rotor cover 19 increases by decompressing the tank 1 by the vacuum pump 8, for example. Further, the system 50 may have a feature wherein the rotating shaft of the dispersing device is installed in a vertical direction so that the mixture (the raw material at first) from the axial center of the lower rotor and the additives are supplied from the axial center of the upper rotor.

Thus, since, unlike the prior-art system, the system 30, 40, 50 for dispersing by circulating a mixture avoids causing the mixture from reaching the part 16 for sealing the shaft so as to thereby saturate the dispersing device with the mixture, a shaft seal that has a simple structure and a low cost can, be used. Further, its life can be prolonged.

In the system 30, 40, 50 for dispersing by circulating the mixture or the dispersing device 3, 51 in it, a driving mechanism for moving at least one rotor of the pair of rotors may be provided so that that one rotor is moved closer to or away from the other rotor. The driving mechanism is provided in the system for dispersing by circulating a mixture to prevent the failure of the devices or the piping due to the increased pressure in the piping caused by clogging the gap between the pair of rotors or the rotor and the stator of the dispersing device. The specific structure, functions, and effects of it are in detail discussed by referring to the system 130 for dispersing by circulating a mixture as in FIG. 7.

Figure 7:
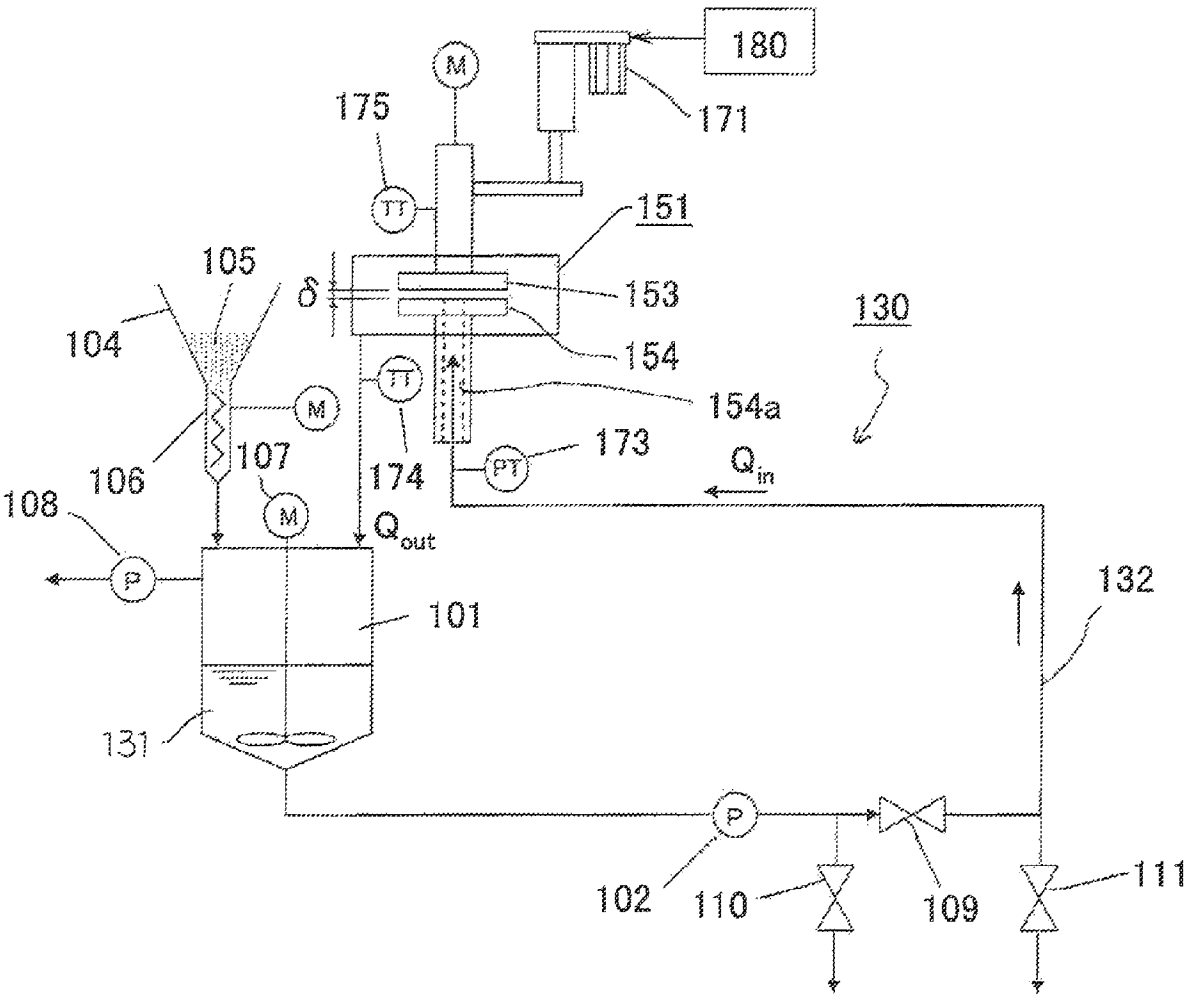
FIG. 7 is a schematic diagram illustrating another embodiment of the system for dispersing by circulating a mixture of the present invention, wherein a driving mechanism is provided for driving a rotor or stator of the dispersing device.

Next, with reference to FIG. 7, the system 130 for dispersing by circulating a mixture, to which the present invention is applied, is discussed. The system 130 for dispersing by circulating a mixture has been discussed as one that disperses the slurry mixture 131 by circulating it like the system 30, 40, 50 for dispersing by circulating a mixture. However, it is not limited to this.

As shown in FIG. 7, the system 130 for dispersing by circulating a mixture comprises a rotating and continuously dispersing device 151 that disperses a mixture 131, a tank 101 that is connected to the outlet of the dispersing device 151, the circulating pump 102 that is connected to the outlet of the tank 101 to circulate the mixture 131, and the piping 132 that connects in series the dispersing device 151, the tank 101, and the circulating pump 102. The dispersing device 151 has the rotor 153 and the stator 154. In the dispersing device 151 the outflow of the mixture is greater than the inflow, so that the amount of the mixture 131 in the dispersing device 151 is maintained at a level where the part for sealing a shaft in the dispersing device 151 is not immersed. Though the part for sealing a shaft is not illustrated for the dispersing device 151, the part for sealing a shaft that is similar to the part 16 in FIG. 5 is provided to the rotor 153.

Like the operation discussed with reference to FIG. 1, at first the fluid that circulates through the tank 101, the dispersing device 151, and the piping 132, is a raw material. It gradually becomes a mixture in which additives are dispersed as it goes through the dispersing device 151. Finally it becomes a processed mixture that has been dispersed. In the above and following discussion both the first "raw material" and the "mixture" that is being processed are called a "mixture."

The system 130 for dispersing by circulating a mixture has a rotating and continuously dispersing device 151 in which the mixture is supplied from the hollow portion of a rotating hollow shaft. The mixture is supplied to the dispersing device 151 by the circulating pump 102. The rate of the discharged mixture (also called "outflow") $Q_{out}$ that is discharged from a rotor cover, which is a casing of the dispersing device 151, is made to be greater than the rate of the supplied mixture (also called "inflow") $Q_{in}$ that is supplied by the circulating pump 102. Thus no mixture accumulates within the rotor cover. Further, no mixture reaches the part for sealing a shaft. The dispersing device 151 may be changed to have a pair of rotating rotors. By doing so, the centrifugal force of the rotors is effectively used and the effect of preventing the mixture from reaching the part for sealing is achieved.

The system 130 for dispersing by circulating the mixture comprises a driving mechanism 171 for moving at least the rotor 143 or the stator 154 of the dispersing device 151, to move one closer to or away from the other. It also comprises a controller 180 that controls the driving mechanism 171. The driving mechanism 171 may be, for example, a servo cylinder. It moves up and down a unit that includes the rotor 153, a rotating shaft for the rotor 153, and a motor M for rotating them, so that the gap between the rotor 153 and the stator 154 is enlarged or narrowed. The system 130 for dispersing by circulating the mixture that comprises the driving mechanism 171 can prevent the failure of the devices, such as the pump, or the piping (especially a fitting) if the pressure in the piping has been or may be increased by clogging the gap between the rotor 153 and the stator 154.

The controller 180 adjusts the gap between the rotor 153 and the stator 154 based on both the detected pressure of the sensor 173 that detects the pressure of the mixture between the rotor and the stator and the detected temperature of the sensor 174 that detects the temperature of the mixture discharged from the gap between them. The controller 180 may adjust it based on the detection of either the pressure sensor 173 or the temperature sensor 174.

The pressure sensor 173 is placed at the position where the pressure becomes the highest in the piping 132. For example, as shown in FIG. 7, it is placed before the point where the additives are added to the dispersing device 151. If a servo cylinder is used for the driving mechanism 171, the load cell that is provided at the tip of the cylinder may be used for a pressure sensor. Alternatively, the pressure sensor placed in the servo cylinder may be used for that.

As shown in FIG. 7, the temperature sensor 174 is attached to the piping 132 at a point just after the outlet of the dispersing device 151, to detect the temperature of the mixture that is discharged from the dispersing device 151. Further, the temperature sensor 175 that detects the temperature of the bearing portion of the rotor 153 is provided in the system 130 for dispersing by circulating a mixture. By preliminarily measuring the relation between the detection by that sensor 175 and the gap δ to store it in the controller 180, the controller 180 adjusts the gap δ by operating the drive unit 171 to drive the rotor 153 in the axial direction based on the detection by the temperature sensor 175. Thus the pressure can be prevented from increasing.

Below further details are discussed. As shown in FIG. 7, the discharging port of the tank 101 that stores the mixture is connected to the circulating pump 102. The circulating pump 102 delivers and circulates the mixture. The feeder 106 that is located above the tank 101 adds the additives 105 (a liquid or powder) that are stored in the hopper 104 into the mixture (the raw material at first) that circulates. The mixture to which the additives have been added is supplied in the rotating and continuously dispersing device 151 installed above the tank 101 in the vertical (perpendicular) direction.

The dispersing device 151 has the rotor 153 and the stator 154 that are arranged so as to perpendicularly face each other. The dispersing device 151 has a perpendicular axis such that the rotor 153 is located in the upper part and the stator 154 is located in the lower part. They may be substituted by a pair of rotors that rotate in reverse directions. Further, the axis is horizontally arranged so that the rotor and the stator horizontally face each other. The rotor 153 and the stator 154 cause the additive to be uniformly dispersed in the raw material. The mixture that has been dispersed between the rotor 153 and the stator 154 of the dispersing device 151 is returned to the tank 101 by gravity, without accumulating in the rotor cover of the dispersing device 151. The mixture in the tank 101 is prevented from being segregated, by stirring it by the agitator 107.

For the feeder 106 of the additives 105, a screw feeder, a rotary valve, a plunger pump, etc., can be suitably used. The position to place the feeder 106 may be on the piping 132 for the circulation, that is, any place in the piping 132 can be arbitrarily chosen.

The vacuum pump 108 is connected to the tank 101. When the amount of the discharge from the dispersing device 151 is low, it can decompress the tank so as to assist discharging the mixture from the dispersing device 151. Further, the decompression by the vacuum pump 108 is also used for degassing the mixture when air bubbles mix with it.

When the system 130 for dispersing by circulating a mixture is operating the valve 109 is normally open and the valves 110, 111 are normally closed. Thereby the processed mixture can be discharged through the valve 110 and then collected. Further, the mixture that remains in the dispersing device 151 or the piping 132 may be discharged and recovered by opening the valve 111. The valve for discharging or recovering the mixture can be placed at an arbitrary place in the tank or the piping.

Since the flow of the mixture in the rotor of the dispersing device 151 is the same as that of the dispersing device 51 that is discussed with reference to FIG. 5, a duplicate explanation is omitted. The mixture is supplied to the gap between the rotor 153 and the stator 154 through the center of the hollow shaft 154*a* that is located in the lower part of the stator 154. It is radially discharged by the centrifugal force from the outer circumference of them through the gap. When doing so, the mixture is dispersed by a shearing force and is discharged along the inner wall of the rotor cover.

The rotor 153 and the stator 154 of the dispersing device 151 may have the same shape as the rotors 53 and 54 that are discussed with reference to FIG. 5. That is, though the stator 154 is shown to be flat in FIG. 7, the projection 54*c* for protecting the shaft may be formed on it like the rotor 54 of FIG. 5. In this case the same effect as that of the dispersing device 51 that has the rotor 54 can be achieved. Further, in the dispersing device 151, the faces of the rotor 153 and the stator 154 that face each other may be made of ceramics like those discussed with reference to FIG. 6.

As seen from the above discussion, the system 130 for dispersing by circulating a mixture, to which the present invention is applied, comprises the dispersing device 151, the tank 101, the circulating pump 102, and the piping 132. It has the feature wherein the outflow of the mixture is greater than the inflow so that the amount of the mixture in the dispersing device 151 is maintained at a level where no part for sealing a shaft in the dispersing device 151 is immersed. The method for dispersing by circulating a mixture, to which the present invention is applied, has the features for a method for dispersing by circulating a slurry or liquid mixture wherein the mixture 131 is dispersed by the rotating and continuously dispersing device 151. When it is circulated through the piping 132 that connects in series the device 151, the tank 101 that is connected to the outlet of the device 151, and the circulating pump 102, the outflow is greater than the inflow, so that the mixture in the device 151 is maintained at a level where no part for sealing a shaft 16 is immersed.

The system 130 for dispersing by circulating a mixture can simplify the structure of the part for sealing a shaft of the dispersing device to disperse the mixture, since no mixture reaches that part. Since the life of the part for sealing a shaft can be prolonged, the maintenance of the dispersing device or the entire system can be reduced. Thus, the system and the method achieve the simplification of the structure, simplification of the maintenance, and reduction of the cost.

The system 130 for dispersing by circulating a mixture avoids causing the mixture from reaching the shaft seals of the rotating and continuously dispersing machine. Further, for using the rotating and continuously dispersing device to which the mixture is supplied from the hollow portion of the rotating hollow shafts, the system prevents the mixture from reaching the part for sealing the shaft by using the rotations (centrifugal forces) of the shafts or the rotor and by controlling the inflow into, and outflow from, the rotor. Thus no mixture reaches the part for sealing the shaft that seals the inside and the exterior of the casing (the rotor cover) that stores the rotor. By using the system, since no liquid reaches the part for sealing the shaft, the shaft seal can be simplified and its cost is reduced. And the life of the shaft seal can be prolonged. Further, in the system 130 for dispersing by circulating a mixture, a pump may be provided between the dispersing device 151 and the tank 101 like the pump 12 that is discussed with reference to FIG. 3. By using that pump or the vacuum pump 108, the mixture in the dispersing device can be prevented from saturating the device. Thus the life of the part for sealing the shaft can be prolonged.

Further, the system 130 for dispersing by circulating a mixture achieves its characteristic effects by having a driving mechanism 171. Before discussing the characteristic effects by doing so, the problem that would occur in the system 130 for dispersing by circulating a mixture that has no mechanism 171 is discussed. That is, a problem in the system for dispersing by circulating a mixture that has no driving mechanism, failures of the devices or the piping due to an abnormal increase of the internal pressure in the piping may be considered. The most probable cause to abnormally increase the internal pressure in the piping, may be the plugging of the solid parts at the part where the fluid resistance is at the maximum, i.e., the gap between the rotor and the stator (corresponding to the gap δ in FIG. 7) or between the pair of rotors. For example, to prevent the plugging of the solid parts so as to protect the devices and the system, an upper limit for the pressure may preliminarily be set, and the pressure at the point where the maximum pressure is generated by a pressure sensor is detected. The system may be configured so that, if that pressure exceeds the upper limit, the operation is stopped. However, in so configuring the system a certain time is required to restart the system, to thereby lose time. Thus it is desirable to prevent the pressure from increasing prior to it reaching the upper limit, i.e., removing the plugging in the gap between the rotor and the stator or the pair of rotors.

The methods of solving the plugging of the solid parts in the gap between the rotor and the stator or in the pair of rotors include first broadening the gap, or, second, increasing the rotor speed, or, third, decreasing the pumping rate. That is, if the detected pressure exceeds the predetermined threshold, the gap is broadened to allow the plugged solid parts to flow, as in the first method, for example. For the second method, the speed of the rotor is increased so as to increase a shearing force to thereby destroy the solid parts that are plugged at the gap. For the third method, the pumping rate is reduced, to decrease the pressure in the piping so that more time is available until the plugged solid parts are removed by destroying them by the shearing force generated by the original speed of the rotation of the rotors. Among these methods, the first one is the most direct, and the best in view of removing the plugging. Thus the system 130 for dispersing by circulating a mixture adopts it. The second and third methods are essential for destroying the plugged solid parts. However, if the plugged solid parts have a high strength, they may not be immediately destroyed so as to be removed. Herein, the functions and effects are discussed assuming the first method is used. However, the second or third method may be used instead of, or in addition to, the first method. That is, after the gap is broadened to allow the plugged solid parts to flow and to end the increase of the pressure, then, if necessary, the speed of the rotation is increased, or the flow rate is decreased. Then the gap, the rotating speed, or the flow rate is gradually returned to the original setting (the value for the normal operation) during the circulating operation. This is an efficient way. The controller 180 should control the operation.

As discussed above, the system 130 for dispersing by circulating a mixture has the driving mechanism 171, which is a servo cylinder, which adjusts the gap δ between the rotor 153 and the stator 154. The system 130 for dispersing by circulating a mixture can disperse the slurry mixture that has a high concentration and a high viscosity. The motor M is connected to the upper disk member to constitute the rotor 153. The upper unit, which includes the rotor 153, is moved up and down by the driving mechanism 171 (a servo cylinder) to adjust the gap δ between the rotor 153 and the stators 154. To improve the endurance against the slurry, the lower disk member is constructed to be the stator 154, which has no part for sealing a shaft (since no part rotates, no part for sealing a shaft is needed). The slurry mixture that is being dispersed is supplied to a dispersing part (between the rotor 153 and the stators 154) through the center shaft of the stator 154. The pressure is detected by the pressure sensor 173 that is placed at the position where the pressure rises most. However, the pressure sensor may be placed within the driving mechanism 171 (a servo cylinder), or the pressure may be detected by a load cell that is provided at the tip of the cylinder. The control of the rate that the rotor rotates or the rate that the pump pumps may be carried out by the controller 180 via inverters that are connected to respective driving motors.

For the dispersing process in the system 130 for dispersing by circulating a mixture, if the characteristics of the mixture can be predicted, the efficiency is improved by preliminarily constructing the program that controls the gap δ between the rotor 153 and the stator 154, the rotating speed, the flow rate, etc. For example, in the process of circulating a liquid raw material, gradually adding powdery additives into it, and producing the slurry mixture, the solid parts may clump in the early stages of the operation, to thereby plug the gap between the rotor and the stator. In this case, for the early stages of the operation, the gap is preliminarily broadened, and the speed of the rotation is increased. No possibility of the gap being plugged can occur after the powdery additives are added, and clumped solid parts are destroyed during the circulation of the liquid raw material and the powdery additives to thereby stabilize the characteristics of the slurry. In this stage the gap and the speed of the rotation are returned to the original settings (the values for the normal operation), to carry out the desired dispersion. In this case, since reducing the flow means a reduction in the amount of the liquid to pass through the shearing (dispersing) portion, the time for the process is lengthened. Thus this method is not necessarily carried out.

In the step of producing the slurry in the system 130 for dispersing by circulating a mixture, when the powdery additives are added multiple times, then the optimal gap between the rotor and the stator, the optimal speed of the rotation, and the optimal flow rate, may differ each time.

Thus the program for controlling the operation is prepared so as to achieve an efficient dispersing operation.

Further, in the step of discharging the dispersed mixture after finishing the dispersion in the system 130 for dispersing by circulating a mixture, efficient processing can be achieved by controlling the operation. The step of discharging the mixture follows the step of dispersing it without stopping the operation. At this time, the valve 109 is closed and the valves 110, 111 are open. Thus the mixture (a product) can be discharged through the valves 110, 111 to then be recovered. To prevent excessive dispersing, the dispersing device 151 is stopped, i.e., the rotor 153 is stopped. Thus the mixture (a product) between the rotor 153 and the stator 154 is subject to a large fluid resistance and it is hard to discharge it. At this time, by broadening the gap, the flow resistance can be reduced, to accelerate the discharging. This effect is great for a mixture having a high viscosity or for a dispersing device in which a buffer is formed in the rotor or the stator (below discussed with reference to FIGS. 8, 9, and 10), since the amount of the mixture to be discharged is large.

In a disk-type dispersing device, such as the dispersing device 151, the members that face each other in the rotor 153 and the stator 154 may generate heat by friction, since they generate a large shearing force to disperse the mixture by high-speed rotation. The gap between the rotor 153 and the stator 154 may decrease due to the thermal expansion of the facing members, shafts, and their associated parts.

If the gap between the rotor 153 and the stator 154 decreases, the flow resistance increases, to thereby cause an abnormal increase in the pressure. Thus the temperature of the raw material is detected as well as the pressure to be used for predicting and preventing any increase in the pressure. Thus the safety of the system can be improved. Since the portion where the temperature in the raw material rises most is the gap between the rotor 153 and the stator 154 and that portion rotates at a high speed, detecting the temperature is difficult. However, by placing the temperature sensor 174 in the piping just after that portion, the temperature that is almost the same as the highest one can be detected.

If necessary, the temperature at the bearing may be detected by the temperature sensor 175. By preliminarily investigating the relationship between the temperature and the gap between the rotor 153 and the stator 154, the decrease in the gap due to the increase in the temperature can be corrected by a means such as a servo cylinder (the driving mechanism 171), to maintain the proper gap. Thus the increase in the pressure can be prevented. Though the purpose of this control is to prevent any increase in the pressure, it also prevents any increase in the temperature.

Further, controlling the operation based on detected temperatures can be also used for these two purposes: The first purpose considers the fact that the decrease of the gap by thermal expansion causes an overload by the contact of the rotor 153 with the stator 154 (or a pair of rotors), an abnormal noise (a noise), or a failure of the parts that face each other (disk members). That is, the first purpose is to prevent these troubles and to properly control the gap. The second purpose is to better control the operation for controlling the temperature to prevent the raw material from deteriorating due to the rise of the temperature, etc. That is, if the detected temperature of the mixture exceeds a predetermined value, then, regardless of the pressure, the gap between the rotor 153 and the stator 154 is increased, and the speed of the rotation of the rotor 153 is decreased, so that the heat of the mixture generated by friction is reduced.

As discussed above, the system 130 for dispersing by circulating a mixture that comprises the driving mechanism 171 prevents the mixture from plugging the gap δ between the rotor 153 and the stator 154 in the dispersing device 151, and prevents a failure of a device or piping due to the increase of the internal pressure of the piping. The driving mechanism 171 may be used not only in the dispersing device having a rotor and a stator, but also in the dispersing device having a pair of rotors, such as the dispersing devices 3, 51. It prevents the mixture from plugging the gap between a pair of rotors, and prevents a failure of a device or piping due to the increase of the internal pressure of the piping.

Since in the system 130 for dispersing by circulating a mixture the controller 180 is configured to adjust the gap (the gap δ) between the rotor 153 and the stator 154 based on the detection of the pressure sensor 173 or the detection of the temperature sensor 174, or both of them, the condition of the plugging in the mixture may be detected in advance. Thus plugging the gap between the pair of rotors and a failure of a device or piping can certainly be prevented.

Further, the driving mechanism 171 can be used for a dispersing device that has a buffering section. The driving mechanism 171 achieves an effect that is unique to the dispersing device that has a buffering section, as well as achieving the effects such as those discussed above. Next, the dispersing device 200 in FIGS. 8, 9, and 10 is discussed, as an example of a dispersing device that has a buffering section.

Next, the dispersing device 200 that is suitably used for the system 1 for dispersing by circulating a mixture and the method for dispersing by circulation is in detail discussed with reference to FIGS. 8, 9, and 10. The dispersing device 200 in FIG. 8 etc., is a continuously dispersing device that efficiently disperses a plurality of the powdery substances in a liquid or slurry (a mixture of a powdery substance and a fluid). The dispersing device 200 certainly applies shearing energy to all the raw materials, and incorporates the local dispersion by a shearing force and the large-scale dispersion, to efficiently disperse.

Figure 8:
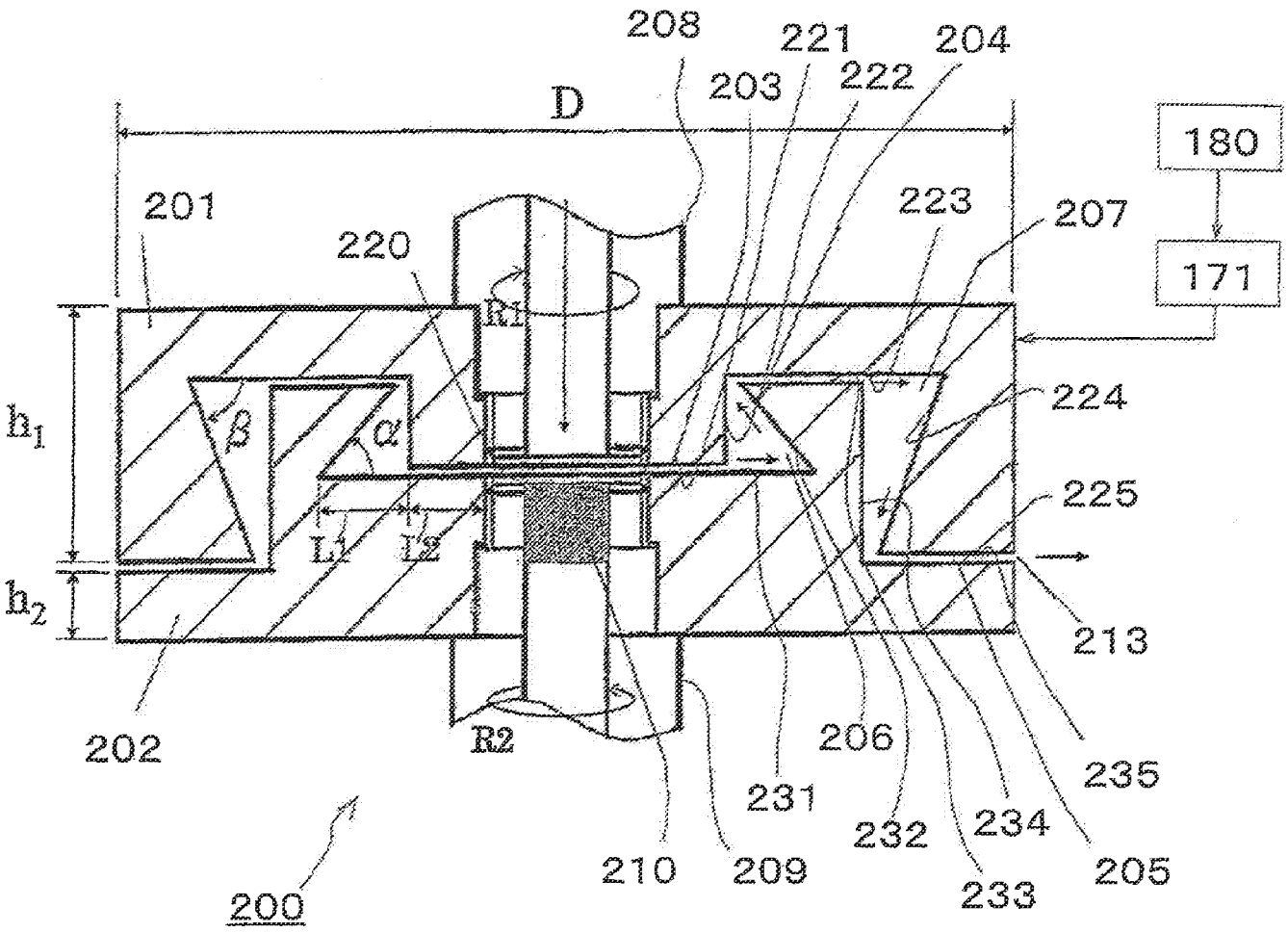
FIG. 8 is a schematic sectional drawing of the dispersing device that constitutes another embodiment of the system for dispersing by circulating a mixture of the present invention, wherein the dispersing device has a buffering section.
Figure 9:
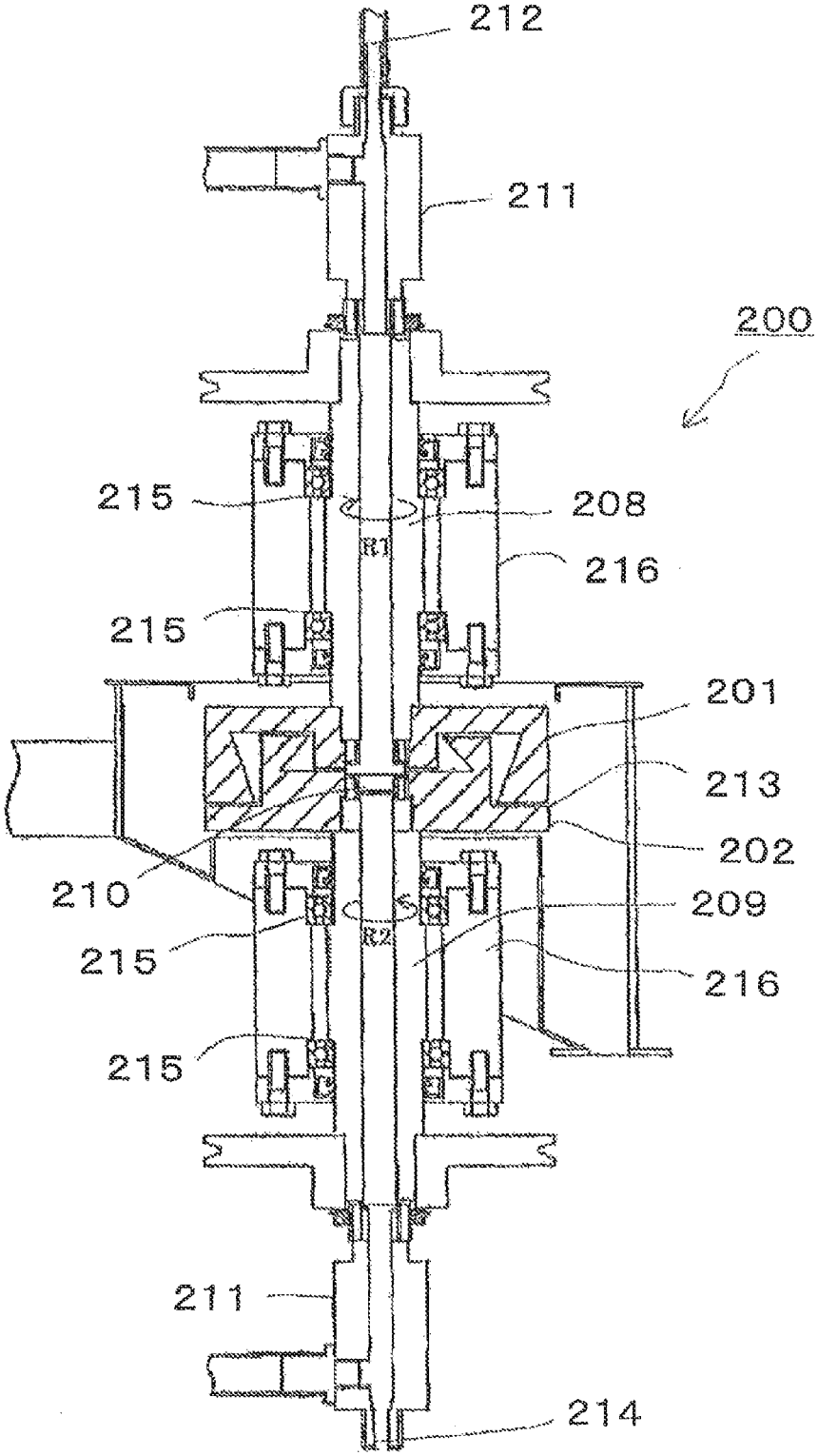
FIG. 9 is a schematic sectional drawing of the main part of the dispersing device in FIG. 8.
Figure 10:
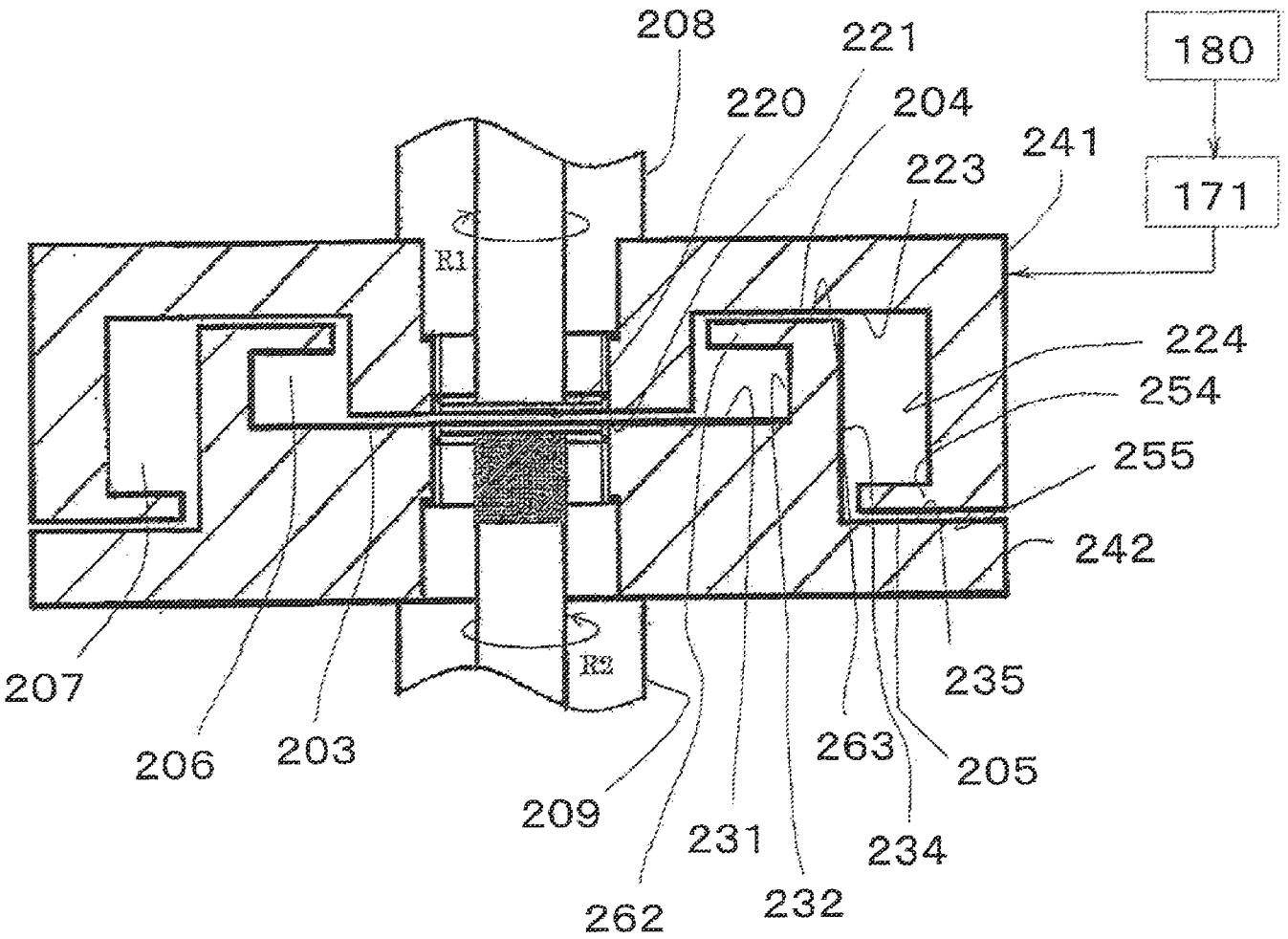
FIG. 10 is a schematic sectional drawing showing the modification of the dispersing device that has a buffering section, which dispersing device is yet another embodiment of the dispersing device that constitutes the system for dispersing by circulating a mixture of the present invention.

In detail, as in FIGS. 8 and 9, the dispersing device 200 combines the first rotor 201 and second rotor 202, to thereby face each other. It causes the raw material to pass through the gap between the rotors 201, 202 radially and outwardly to disperse the material. It comprises a first rotating device 208 for rotating the first rotor 201 in a first direction R1 and a second rotating device 209 for rotating the second rotor 202 in a second direction R2 that is the reverse of the first direction R1. The port 220 for discharging the raw material is formed at the center of the rotation of the first rotor 201 or the second rotor 202.

Since, by constructing the dispersing device 200 in this way, the first rotor 201 and the second rotor 202 rotate in reverse directions, shearing energy can be certainly given to all the raw materials, to efficiently disperse them.

In the dispersing device 200, as shown in FIG. 8, for example, the gap 203 is formed in the outer circumference of the port 220 for discharging the raw material between the flat surface 221 of the first rotor 201 and the flat surface 231 of the second rotor 202. A buffering section 206, in which the gap between the first rotor 201 and the second rotor 202 is larger than that of the gap 203, is formed in the outer circumference of the gap 203. The side 232 on the outer circumference that causes the gap between the first rotor 201 and the second rotor 202 to be narrower than that of the buffering section 206 is formed in the outer circumference of the buffering section 206 in the second rotor 202.

By constructing the dispersing device 200 in this way, since the gap carries out the local dispersion by shearing and the buffering section carries out the large-scale dispersion, the dispersing device 200 can achieve efficient dispersion.

Further, as shown in FIG. 8 for example, in the dispersing device 200 the side 232 on the outer circumference is formed to be parallel to the rotating shaft 208 of the first rotor 201 or inclined toward the center of the rotation. By constructing the dispersing device 200 in this way, since the side on the outer circumference is formed in parallel with the first rotating shaft or inclined toward the center of the rotation, no raw material flows from the buffering section to the outer circumference, unless the raw material flows into the buffering section at an amount that exceeds the capacity of the buffering section. The raw material accumulates in the buffering section. Therefore, since a new raw material flows, at a high speed, from the gap into the material that is accumulated in the buffering section to violently mix with it, the material is more uniformly dispersed in the buffering section.

As shown in FIG. 10, for example, the dispersing device 200 may have an overhang 262 that extends toward the center of the rotation at the end of the side 232 on the outer circumference. By constructing the dispersing device 200 in this way, since the end of the side on the outer circumference is formed as an overhang that extends toward the center of the rotation, no raw material flows from the buffering section to the outer circumference, unless the raw material flows into the buffering section at an amount that exceeds the capacity of the buffering section. The raw material accumulates in the buffering section. Therefore, since a new raw material flows, at a high speed, from the gap into the material that has accumulated in the buffering section to violently mix with it, the material is more uniformly dispersed in the buffering section.

As shown in FIG. 8, for example, the gap 203 is located adjacent to the port 220 for discharging the raw material in the dispersing device 200. By constructing the dispersing device 200 in this way, the centrifugal force generated by the rotation of the first rotor and the second rotor is applied to the raw material in the gap to cause it to flow outside. Thus its flow velocity increases so that a negative pressure is generated at the inner side. Thus a raw material is suctioned through the port for discharging it to the gap.

As shown in FIG. 8, for example, in the dispersing device 200 the second gap 204 is formed in the outer circumference of the buffering section 206 between the flat face 223 of the first rotor 201 and the flat face 233 of the second rotor 202. The gap between these faces of the second gap 204 is narrower than that of the gap 203. The second buffering section 207, in which the gap between the first rotor 201 and the second rotor 202 is larger than that of the second gap 204, is formed in the outer circumference of the gap 204. The second side 224 on the outer circumference that makes the gap between the first rotor 201 and the second rotor 202 narrower than the second buffering section 207, is formed in the outer circumference of the second buffering section 207 in the first rotor 201. Further, the third gap 205, which is narrower than the gap 204, is formed in the outer circumference of the buffering section 207 by the flat face 225 of the first rotor 201 and the flat face 235 of the second rotor 202. By constructing the dispersing device 200 in this way, since in addition to the gap and the buffering section the second gap carries out the local dispersion by shearing and the second buffering section carries out the large-scale dispersion, it becomes a continuously dispersing device that effectively and repeatedly disperses the raw material. Further, since the third gap carries out a local dispersion by shearing, it becomes a continuously dispersing device that more effectively and repeatedly disperses the raw material.

As shown in FIG. 8 for example, in the dispersing device 200 the buffering section 206 is formed by an indented portion on the first rotor 201, the side 232 on the outer circumference is formed in the second rotor 202, the second buffering section 207 is formed by an indented portion on the second rotor 202, and the second side 224 on the outer circumference is formed in the first rotor 201. By constructing the dispersing device 200 in this way, since the indented portions are alternatively formed in the first rotor and the second rotor, the gap, the buffering section, the side on the outer circumference, the second gap, the second buffering section, and the second side on the outer circumference, are all formed. Thus manufacturing the dispersing device that alternatively and continuously carries out local dispersions by shearing and large-scale dispersions for uniformly dispersing the material can be facilitated.

Next, with reference to FIGS. 8, 9, and 10, the dispersing device 200 is discussed in further detail. The dispersing device 200 combines two rotors that rotate at high speeds in reverse directions. This causes the raw material to pass through the narrow gap between them by centrifugal force so that multiple raw materials are uniformly dispersed. As shown in FIG. 8, by coaxially combining two rotors 201, 202 that have respective concaves and convexes and vertically face each other, the concavities and convexities are matched to alternatively form the narrow gaps 203, 204, 205 and broad spaces 206, 207. Herein, the narrow gaps 203, 204, 205 that generate high shearing forces are denoted as the sections for generating shearing forces. The wide spaces 206, 207 where the raw materials are mixed, which spaces are larger than the sizes of the sections for generating shearing forces, are denoted as buffering sections. As shown in FIG. 9, the rotors 201, 202 are connected to the hollow rotating shafts 208, 209, which are supported via the bearing 215 by the bearing housing 216 that is stiffly anchored (no way to anchor it is shown). They are rotated by an electric motor (not shown) that is connected to a belt, a chain, a gear, etc. They rotate in reverse directions R1, R2. Herein, assume that the rotating shafts 208, 209 rotate clockwise as seen from the ports 212, 214 for discharging the raw material, respectively. The speeds of the rotation can be arbitrarily determined depending on the intended raw material or the targeted degree of dispersion. The raw material supplied to the ports 212, 214 for supplying raw materials flows through the hollow of the rotating hollow shaft and is supplied to the gap between the two rotors 201 and 202 from the port 220 for discharging the raw material that is formed in the center of the rotation of the rotors 201, 202. In this embodiment the port for discharging the raw material of the rotating hollow shaft 209 is closed by a plug 210*a* to prevent the raw material from flowing in and out.

In the dispersing device 200, the outside diameter D of the rotors 201, 202 in FIG. 8 is 200 mm, and the heights h1, h2 are 55 mm and 15 mm, respectively The gaps of the sections 203, 204, 205 for generating shearing forces can be adjusted to 0.05-2 mm. The gaps of the sections 203, 204, 205 for generating shearing forces are not necessarily constant, but may be suitably changed, depending on the objects, the design of the shapes, and the sizes of the rotors 201, 202. For example, the agglomerated particles of the raw material are dissolved step by step by narrowing the gaps of the parts 203, 204, 205 for generating shearing forces. Thus uniformly dispersing the materials is facilitated. The angles α, β of the sides 232, 224 on the outer circumference of the buffering sections 206, 207 are 50 degrees and 70 degrees, respectively. However, they are not limited to these angles. They may be arbitrarily selected from acute or right angles depending on the designs of the shapes and the sizes of the rotors 201, 202. That is, the sides may incline toward the center of the rotation (in the direction toward the rotating hollow shafts 208, 209) or stand parallel to the rotating hollow shafts 208, 209. The speeds of the rotation can be set at 0-1,720 rpm by an inverter control in this dispersing device. However, they may be suitably changed by any electric motor, a pulley, a gear, etc., that is selected.

Now, with reference to FIG. 8, the structures of the sections 203, 204, 205 for generating shearing forces and the buffering sections 206, 207 are discussed. The face of the upper rotor 202 that faces the lower rotor 202 is formed like the flat face 221 in the outer circumference of the port 220 for discharging the raw material. It is vertical to the rotating shaft. The indented portion, which consists of the side on the inner circumference 222, the flat surface 223 parallel to the flat surface 221, and the side 224 on the outer circumference, is formed in the outer circumference side of the flat surface 221. In the outer circumference of the flat face 221 an indented portion is formed by the side 222 on the inner circumference, a flat face 223 that is parallel to the flat face 221, and the side 224 on the outer circumference. The side 224 on the outer circumference extends toward the lower rotor 202 and beyond the flat surface 221. At the end of it the flat surface 225 that is parallel to the flat surface 221 is formed. On the face of the lower rotor 202 that faces the upper rotor 201, the flat face 231 that in parallel faces the flat face 221 is formed. The flat surface 231 extends toward the outer circumference and beyond the side 222 on the inner circumference. The side 232 on the outer circumference is formed toward the upper rotor 201 from the flat surface 231. The flat face 233 that in parallel faces the flat surface 223 is formed from the end of the side 232 on the outer circumference. An indented portion is formed in the outer circumference of the flat surface 233 by the flat face 234 that is located in the inner side of the side 224 on the outer circumference, and the flat face 235 that in parallel faces the flat face 225.

By combining the upper rotor 201 and the lower rotor 202 that have those faces, the section 203 for generating shearing forces is formed by the flat face 221 and the flat face 231, the section 204 for generating shearing forces is formed by the flat face 223 and the flat face 233, and the section 205 for generating shearing forces is formed by the flat face 225 and the flat face 235. The buffering section 206 is formed as a portion that is surrounded by the side 222 on the inner circumference, the flat surface 223, the side 232 on the outer circumference, and the flat surface 231. The buffering section 207 is formed as a portion that is surrounded by the side 234 on the inner circumference, the flat face 223, the side 224 on the outer circumference, and the flat surface 235. Since the side 224 on the outer circumference extends toward the lower rotor 202 and beyond the flat face 221 to form the buffering section 207, the capacity of the buffering section 207 becomes large, to uniformly disperse the material in a larger scale.

In the above embodiment the side 224 on the outer circumference extends to the lower rotor 202, beyond the flat face 221. However, the side 224 may extend up to the same position as the flat face 221, that is, the flat face 221 and the flat face 225 may be on the same level. By constructing the sections for generating shearing forces and the buffering sections in this way, since an indented portion is formed in the upper rotor 201 and a projection is formed in the lower rotor 202 (a portion surrounded by the side 232 on the outer circumference, the flat surface 233, and the side 234 on the inner circumference), three sections 203, 204, 205 for generating shearing forces and two buffering sections 206, 207 can be formed. Thus manufacturing the dispersing device that alternately and continuously carries out dispersions by local shearing and larger-scale dispersions in a portion that is larger than that for the dispersions by local shearing can be facilitated. Further, the side 224 on the outer circumference may extend up to the near side of the flat face 221.

The flat surfaces 221, 223, 225, 231, 233, and 235 are explained as being perpendicular to the rotating shaft and parallel to each other. However, they may be not vertical to the rotating shaft or not parallel to each other. Further, the flat faces that face each other to form the sections 203, 204, 205 for generating shearing forces may not be parallel to each other. If the gaps between the sections 203, 204, 205 for generating shearing forces become narrower toward the outer circumference, the structure dissolves the agglomerated particles of the raw material to make them finer, step by step.

The buffering sections 206, 207 are the portions that store liquid in order to mix the raw material that has been locally dispersed at the sections 203, 204 for generating shearing forces. They have large capacities. Thus, for example, the length L1 in the radial direction of the flat face 231 for forming the buffering section 206 is at least 0.5 or more times, normally one or more times, of the length L2 in the radial direction of the flat face that forms the section 203 for generating shearing forces by facing the flat surface 221. The height of the buffering section 206 (the sum of the size of the gap of the section 203 for generating shearing forces plus the height of the side 222 on the inner circumference) is at least three times, but normally five times or more, the size of the gap 203.

In FIG. 8 the flow of the raw material is denoted by arrows. Though for simplicity only one flow is shown, actually the same type of flow occurs in every place in the space formed by the rotors 201, 202. Now, FIG. 9 is also referred to again. When the rotors 201, 202 are rotating, the raw material is supplied from the port 212 for supplying raw materials of the swivel joint 211 that is connected to the hollow shaft 208 and is prevented from rotating (not shown). The raw material is supplied to the gap between the two rotors 201, 202 from the port 220 for discharging the raw material. It goes through the section 203 for generating shearing forces, the buffering section 206, the section 204 for generating shearing forces, the buffering section 207, and the section 205 for generating shearing forces, which are formed by the two rotors 201, 202, in sequence along the direction of the centrifugal force. It is discharged from the part 213 for discharging the raw material located on the outer circumference of the rotors. Since the raw material flows to the outer circumference by the centrifugal force to have its velocity increased, the port 220 for discharging the raw material becomes under a negative pressure. Thus the flow of the raw material from the port 220 for discharging the raw material is accelerated.

The cork 210 in the port for discharging the raw material of the hollow shaft 209 may be removed to supply another raw material from the port 214 for supplying the raw material to mix it between the rotors with the raw material supplied from the port 212 for supplying the raw material. However, to do so, the rotors and the hollow shafts must be horizontally placed, or a pump for supplying the raw material must be provided. That is because the negative pressure at the port 220 for discharging the raw material is usually not so low. Thus the raw material cannot be sucked to the top of the hollow shaft 209.

In the dispersing device 200 the two rotating shafts are driven by respective electric motors. However, they may be driven by one electric motor by distributing the power by the gears, etc. The rotating device is composed of these electric motors, a belt, a chain, a gear, etc., and the hollow shafts 208, 209.

Next, with reference to FIG. 8, the process for dispersing the raw material (the method of dispersing) by using the dispersing device 200 alone is discussed. First, the raw material is subject to a high shearing force when it passes through the section 203 for generating shearing forces as the first step such that the aggregated particulates of emulsified or fine powders are dissolved. The raw material in which the aggregated particulates of emulsified or fine powders have been locally dissolved or dispersed or both by the high shearing force at the section for generating shearing forces, is discharged from the section 203 for generating shearing forces and then flows into the first buffering section 206. Since the side 232 on the outer circumference that narrows the gap between rotors 201, 202 is formed in the outer circumference, the raw material that has flowed into the buffering section 206 does not flow out of the buffering section unless the amount of the raw material that has flowed into it exceeds its capacity. Thus the raw material remains there. By the centrifugal force the raw material in the buffering section 206 is pressed against the side 232 on the outer circumference in the buffering section 206. However, since the side 232 on the outer circumference of the buffering section 206 is inclined so as to resist the flow (as shown in FIG. 8), the raw material needs to flow into the buffering section 206 at an amount that exceeds its capacity to discharge it. At this time the raw material that remains in the buffering section 206 then violently mixes with the raw material that flows into the buffering section 206 at a high speed. Thus the raw material that has been locally emulsified or dispersed is uniformly mixed in a larger scale than is the local portion. Next, the raw material passes the second section 204 for generating shearing forces and the second buffering section 207 to be dispersed like in the first section for generating shearing forces and the second buffering section. It passes the third section 205 for generating shearing forces as the last one to be further dispersed.

To uniformly mix the raw material, the raw material to be supplied to the device is preferably dissolved in a premixing as a previous process to emulsify or aggregate particles that are smaller than the minimum gap of the section for generating shearing forces. It is also preferably dispersed uniformly at the minimum volume of the section for generating shearing forces (volume=the area for shearing x the size of the gap). If no emulsified or aggregated particles in a liquid is dissolved to the size that can pass through the gap of the part 203 for generating shearing forces, it is difficult for a droplet or an aggregated particle that is larger than the gap of the part 203 to enter the gap when it flows into the part 203, to thereby cause uneven dispersion or plugging. Thus it may damage the device because of generation of an excessive stress. The wording "dispersing uniformly at the minimum volume of the section for generating shearing forces" means that, when taking out the minimum volume of the raw material that has been premixed, the ratios of a plurality of raw materials are constant regardless of the fact that the emulsified or aggregated particles are dissolved. For example, in FIG. 8 the minimum volume of the section for generating shearing forces is that of the gap 203. It is approximately 0.3 ml when the gap is 0.1 mm. The specific conditions discussed here are those for improving the performance of the dispersing device 200. Though the dispersing device 200 is suitably used for the continuously dispersing system, these conditions do not need to be complied with.

The shape of the buffering section 206, 207 is not necessarily limited to the shape in which the side 232, 224 on the outer circumference inclines as shown in FIG. 8. To increase the capacities of the buffering sections 206, 207, the overhang sections 262, 254 that extend to the centers of the rotation (hollow shafts 208, 209) may be provided at the ends of the sides 232, 224 on the outer circumferences of the buffering sections 206, 207, as shown in FIG. 10. Further, since the flat surface 263 of the overhang section 262 that faces the flat face 223 of the upper rotor 241 forms the section 204 for generating shearing forces, the radial length of the section 204 becomes longer so as to carry out a more localized dispersing. Similarly, the flat face 255 of the overhang section 254 that faces the flat face 235 of the lower rotor 242 forms the larger section 205 for generating shearing forces so as to carry out a more localized dispersing.

Herein, the sections for generating shearing forces are constituted of three steps and the buffering sections are constituted of two steps. However, they are not necessarily limited to this constitution. They may be arbitrarily constituted depending on the raw material that is the object or the targeted degree of dispersing.

By constructing the dispersing device 200 as discussed above, it combines the first rotor and second rotor so as to face each other so as to disperse the raw material by passing it through the gap between the two rotors. It has the first rotating device that rotates the first rotor in the first direction. It also has the second rotating device that rotates the second rotor in the second direction that is reverse to the first direction. The port for discharging the raw material is formed at the center of the rotation of the first rotor. Thus it can efficiently disperse the raw material by efficiently applying shearing energy to all of it.

The gap is formed in the outer circumference of the port for discharging the raw material by the flat faces of the first rotor and the second rotor. The buffering section, in which the distance between the first rotor and the second rotor is larger than the size of the gap, is formed in the outer circumference of the gap. The side on the outer circumference that causes the gap between the first rotor and the second rotor to be narrower than that of the buffering section is formed in the outer circumference of the buffering section in the first or second rotor. Thus mixing for making uniform the raw material in a larger scale is carried out after local mixing by shearing forces. By incorporating mixing for making uniform the raw material in a larger scale with local mixing by shearing forces, an efficient dispersing can be achieved.

The dispersing device 200, which is discussed with reference to FIGS. 8, 9, and 10, has the driving mechanism 171 and the controller 180 that adjust the gap between the rotor 201 and the rotor 202. Since the driving mechanism 171 moves the rotor 201, the plugging of a mixture in the gap δ between the pair of rotors 201, 202 or a failure of the device or piping caused by the increase of the internal pressure can be prevented. Further, the dispersing device has the other effects caused by the driving mechanism 171, which effects are discussed above. Further, the dispersing device 200, which has the driving mechanism 171, can make it easy to discharge the mixture that accumulates in the buffering section by widening the gap between the rotors 201, 202 after the operation is completed. The dispersing device 200 can be used for the systems 30, 40, 50, and 130 for dispersing by circulation, which are discussed above. The systems have an effect for simplifying the structure of the part for sealing the shaft of the dispersing device, since no mixture reaches the part for sealing the shaft. This is a feature of the system for dispersing by circulating the mixture. Thus, the systems achieve a suitable dispersion by circulating a mixture, which is in addition to the dispersing device 200 achieving a high shearing function for the mixture.

The invention claimed is:

1. A system for dispersing by circulating a slurry or liquid mixture to disperse substances in the mixture, the system comprising:

a rotating and continuously dispersing device that disperses the mixture;

a tank that is connected to an outlet of the dispersing device;

a circulating pump that circulates the mixture; and a piping that in series connects the dispersing device, the tank, and the circulating pump;

wherein an outflow of the mixture from the dispersing device is greater than an inflow into the dispersing device so that an amount of the mixture in the dispersing device is maintained at a level where a part for sealing a shaft that is provided inside the dispersing device is not immersed, wherein the dispersing device has a pair of rotors, wherein the mixture flows through a hollow shaft to a gap between the pair of rotors, wherein the mixture is dispersed when it is radially and outwardly discharged from outer circumferences of the rotors through the gap between the pair of rotors, and wherein the system further comprises a driving mechanism that drives at least one of the pair of rotors to approach, or retract from, each other.

2. The system of claim 1, wherein the dispersing device is placed above the tank.

3. The system of claim 1, wherein a pump for increasing the outflow from the dispersing device is provided in the piping between the outlet of the dispersing device and an inlet of the tank.

4. The system of claim 1 or 3, wherein a decompressing pump that decompresses the tank is provided in the tank.

5. The system of claim 1, wherein the pair of rotors horizontally face each other.

6. The system of claim 1, wherein the pair of rotors vertically face each other.

7. The system of claim 6, wherein the mixture is made by mixing a raw material and additives, wherein by the system the raw material is circulated through the piping and the additives are added to the raw material to be dispersed by the dispersing device, and wherein in the dispersing device the raw material is supplied through a hollow shaft of a lower rotor in the pair of rotors and the additives are supplied through a hollow shaft of an upper rotor in the pair of rotors.

8. The system of claim 1, comprising:

a controller that controls the driving mechanism;

wherein the controller adjusts the gap between the pair of rotors based on either a pressure detected by a sensor of the mixture between the pair of rotors or a temperature of the mixture discharged from the gap between the pair of rotors detected by a sensor or both the pressure and temperature.

9. The system of claim 8, wherein the driving mechanism is a servo cylinder.

10. The system of claim 1, wherein the dispersing device has a rotor and a stator that face each other, wherein the mixture flows through a hollow shaft to a gap between the rotor and the stator, and wherein the mixture is dispersed when it is radially and outwardly discharged from the outer circumferences of the rotor and the stator through the gap between the rotor and the stator.

11. The system of claim 10, wherein the rotor and the stator horizontally face each other.

12. The system of claim 10, wherein the rotor and the stator vertically face each other.

13. The system of claim 12, wherein the mixture is made by mixing a material and additives, wherein by the system the raw material is circulated and the additives are added to the raw material to be dispersed by the dispersing device, and wherein in the dispersing device the raw material is supplied through a hollow shaft of the stator that is located on the underside of the rotor and the stator, and wherein the tank has a feeder that supplies the additives to the raw material in the tank.

14. The system of any of claims 10 to 13, further comprising:

a driving mechanism that drives either the rotor or the stator or both of them to approach, or retract from, each other.

15. The system of claim 14, comprising:

a controller that controls the driving mechanism;

wherein the controller adjusts the size of the gap between the rotor and the stator based on either a pressure detected by a sensor of the mixture between the rotor and the stator or a temperature of the mixture discharged from the gap between the rotor and the stator detected by a sensor or both the pressure and temperature.

16. The system of claim 15, wherein the driving mechanism is a servo cylinder.

17. The system of claim 6 or 7, wherein in the dispersing device a projection is formed in the outer circumference of the lower rotor in the pair of rotors to lead the mixture downwardly.

18. The system of claim 17, wherein the projection in the lower rotor that is shaped as a ring and formed in the outer circumference of a back face of the lower rotor.

19. The system of claim 1, wherein faces of the pair of rotors that face each other are made of ceramics.

20. The system of claim 1, wherein the pair of rotors comprise end members that have respective faces facing each other and mounting members that mount the end members wherein the end members can be exchanged, and wherein the end members are made of ceramics and the mounting members are made of metals.

21. The system of claim 1, wherein the pair of rotors comprise end members that have respective faces facing each other, mounting members that mount the end members wherein the end members can be exchanged, and fixing screws that fix the end members to the mounting members, wherein the fixing screws are screwed to the mounting members from faces of the end members, the faces facing each other, to fix the end members to the mounting members, wherein the end members are made of ceramics, wherein recesses are formed in the portions where the fixing screws are screwed in the end members, and wherein the recesses are formed so that heads of the fixing screws are located at positions which are deeper than positions of the faces when the fixing screws are screwed to fix the end members.

22. A method of dispersing by circulating a slurry or liquid mixture to disperse substances in the mixture, which method is carried out by the system of claim 1, wherein the mixture is dispersed by a rotating and continuously dispersing device and circulated through a piping that in series connects the dispersing device, a tank that is connected to an outlet of the dispersing device, and a circulating pump, and wherein an outflow of the mixture from the dispersing device is greater than an inflow into the dispersing device so that an amount of the mixture in the dispersing device is maintained at a level where a part for sealing a shaft that is provided inside the dispersing device is not immersed.

* * * * *